US009340383B2

(12) United States Patent
Kowase et al.

(10) Patent No.: US 9,340,383 B2
(45) Date of Patent: May 17, 2016

(54) IMAGE FORMING APPARATUS

(71) Applicant: KONICA MINOLTA, INC., Chiyoda-ku, Tokyo (JP)

(72) Inventors: Kazuhiko Kowase, Toyokawa (JP); Shohei Yamazaki, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/735,442

(22) Filed: Jun. 10, 2015

(65) Prior Publication Data

US 2015/0368054 A1 Dec. 24, 2015

(30) Foreign Application Priority Data

Jun. 19, 2014 (JP) ..... 2014-126714

(51) Int. Cl.

| | |
|---|---|
| ***B65H 7/06*** | (2006.01) |
| ***B65H 7/02*** | (2006.01) |
| ***B65H 7/18*** | (2006.01) |
| ***B65H 5/06*** | (2006.01) |
| ***B65H 5/26*** | (2006.01) |
| ***B65H 7/20*** | (2006.01) |

(52) U.S. Cl.

CPC ..... *B65H 7/06* (2013.01); *B65H 5/062* (2013.01); *B65H 5/26* (2013.01); *B65H 7/02* (2013.01); *B65H 7/18* (2013.01); *B65H 7/20* (2013.01)

(58) Field of Classification Search

CPC ..... B65H 7/02; B65H 7/06; B65H 7/12; B65H 7/14; B65H 7/18; B65H 7/20

See application file for complete search history.

(56) References Cited

U.S. PATENT DOCUMENTS

| | | | | |
|---|---|---|---|---|
| 8,590,884 | B2 * | 11/2013 | Maruta | G03G 15/6564 271/10.03 |
| 8,757,617 | B2 * | 6/2014 | Fukusada | B65H 5/06 271/258.01 |
| 8,757,618 | B2 * | 6/2014 | Matsumoto | B65H 7/02 271/264 |
| 9,187,280 | B2 * | 11/2015 | Nishii | B65H 7/18 |
| 2009/0057984 | A1 | 3/2009 | Matsumoto et al. | |

FOREIGN PATENT DOCUMENTS

| | | | |
|---|---|---|---|
| JP | 2009062115 | A | 3/2009 |
| JP | 2010265051 | A | 11/2010 |
| JP | 2011230880 | A | 11/2011 |
| JP | 2013119469 | A | 6/2013 |

* cited by examiner

*Primary Examiner* — Luis A Gonzalez
(74) *Attorney, Agent, or Firm* — Holtz, Holtz & Volek PC

(57) ABSTRACT

An image forming apparatus performs a continuous printing job in a normal sheet interval mode as an initially setting mode when an arrival waiting control such as a feed retry control is not performed. In the normal sheet interval mode, a feeding action is performed such that a sheet interval between successive two sheets is set at a predetermined normal sheet interval during the continuous printing. When the initially setting mode is not maintained, the continuous printing is performed with switching the sheet interval mode to an extended sheet interval mode for performing the feeding action with an extended sheet interval which is longer than the normal sheet interval.

20 Claims, 15 Drawing Sheets

FIG.12

| GAP BETWEEN ADDITIONAL PAPER BP AND INITIAL PAPER SHEAF AP [mm] | | 0 ~ | 20 ~ | 30 ~ | 35 ~ 40 |
|---|---|---|---|---|---|
| FEED RETRY CONTROL | | N/A | YES | YES | YES |
| FEED RESULT | ADDITIONAL PAPER BP | ○ | ○ | ○ | × (SIZE ERROR) |
| | FIRST INITIAL PAPER AP1 | ○ | ○ | × (JAM) | — |

IMAGE FORMING APPARATUS

CROSS-REFERENCE TO RELATED APPLICATIONS

This application is based upon and claims the benefit of priority from the prior Japanese Patent Application No. 2014-126714 filed on Jun. 19, 2014, the entire contents of which are incorporated herein by reference.

BACKGROUND OF THE INVENTION

1. Field of the Invention

The present invention relates to an image forming apparatus configured to properly form an image on a sheet of paper even when papers are not properly loaded on a sheet loading section.

2. Description of Related Art

Generally, an image forming apparatus has a sheet feeding section for feeding papers into the apparatus. The sheet feeding section includes a sheet loading section loaded with a plurality of papers by loading and a sheet feed roller for feeding the papers loaded on the sheet loading section into the apparatus. When image forming, papers loaded on the sheet loading section are fed one by one from the topmost one to the apparatus by a feeding action of rotating the sheet feed roller, and then an image is formed on a surface of the fed paper.

Paper replenishment to the sheet loading section is made by a user of the image forming apparatus. Papers on the sheet loading section are not necessarily supplied properly on the sheet loading section, and the loaded state is sometimes not preferable. Further, there is a case that a paper to be fed by the feeding action gets stuck or that the sheet feed roller performing the feeding action makes a slip with the paper. In those cases, even if the feeding action of the sheet feed roller gets started, there may be a sheet feeding failure that the paper is not fed into the apparatus. Some image forming apparatuses are configured to perform a feed retry control of once stopping the started feeding action and retrying the feeding action when the sheet feeding failure occurs. The paper that failed to be fed in the initial feeding action is sometimes fed properly by the feed retry control.

Judgement of whether or not the sheet feeding failure occurs is, for example, made by a sheet sensor provided on the way of a sheet conveying path in the apparatus for detecting arrival and passing of the paper. Specifically, at a usual time when sheet feeding is properly performed, the fed paper arrives at a detection point of the sheet sensor within a predetermined time from start of the feeding action. On the contrary, when the sheet feeding failure occurs, a period of time from start of the feeding action to arrival of the paper at the detection point of the sheet sensor takes longer than usual arrival time. Therefore, in a case that arrival of the paper is not detected by the sheet sensor for a period of time longer than the usual arrival time since start of the feeding action, it is concluded that the sheet feeding failure has occurred and thus the feed retry control is performed.

Japanese Patent Application Publication JP-A-2013-119469 teaches that when the sheet feeding failure occurs in the feeding action, the feed retry control is performed in such a manner that after rotation of the sheet feed roller is stopped and the sheet loading section is once lowered, the section is raised again so that the rotation of the roller is restricted. The feeding action is thus restarted after descent and ascent of the loading section, so that it is possible to properly feed the paper of which a front end has got stuck during the previous feeding action before the feed retry control.

Herein, when papers are added disorderly on the topmost one of papers which have already been loaded properly on the sheet loading section, the added papers are sometimes positioned not to be in contact with the sheet feed roller. Specifically, a person who adds the papers is apt to add the papers on a position apart from the sheet feed roller of the sheet loading section. When the feeding action gets started in this state, the sheet feed roller firstly feeds the topmost one of the initially loaded papers loaded on the sheet loading section and placed below the added papers.

The added papers are loaded on the paper which has started to be fed, and accordingly, the added papers are moved toward the sheet feed roller in accordance with the feeding action of the paper which has started to be fed. When the added papers thus move and arrive at the sheet feed roller, the topmost one of the added papers comes to contact with the sheet feed roller. Namely, the topmost added paper is fed into the apparatus instead of a paper placed beneath the initially fed paper. The paper initially fed and located beneath the added paper is not in contact with the sheet feed roller since the added paper arrives at the roller instead. Therefore, the paper initially fed and located beneath the added paper has been fed but stopped at a position when the added paper starts to be fed.

When the added papers are disorderly supplied on the sheet loading section on which papers have already been loaded, the feed retry control is performed in the above mentioned prior arts and others. The feed retry control is performed because an arrival time from start of the feeding action to arrival of the paper at a detection point of the sheet sensor becomes longer than the usual arrival time by the period of time from start of the feeding action to the time when the topmost one of the added papers comes to contact with the sheet feed roller. In a case that the feed retry control is performed, the topmost one of the fed added papers is detected by the sheet sensor, and the image is properly formed on that detected paper.

However, beneath the added papers, the papers which have been initially loaded on the sheet loading section are present. The topmost one of those papers initially loaded on the sheet loading section is fed but stopped on the way of the sheet conveying path. Therefore, for example, prior arts have the following problems.

Feeding of a paper after all the added papers are fed restarts from a position on which the paper has been fed on the conveying path. Therefore, when images are continuously formed on the last one of the added papers and the paper having been fed on the way of the conveying path, a front end and a rear end of those continuously fed papers could be overlapped each other. In such a double-feeding (multi-feeding), size error and jam could be detected, so that the feeding action could be stopped in the image forming apparatus. Even when the front and rear ends of the successive papers are not overlapped, the apparatus could wrongly detect size error and jam due to a too narrow sheet interval.

For example, Japanese Patent Application Publication No. JP-A-2010-265051 teaches the technique of detecting multi-feeding of papers by use of an ultrasonic sensor. Specifically, it is possible to ensure a preferable sheet interval by detecting a state of multi-feeding and by carrying out conveyance of papers such that the multi-feeding is resolved. However, a sensor for detecting the multi-feeding is required and therefore an image forming apparatus cannot be provided with low cost.

The present invention has been made to solve the above problem of the prior arts. Namely, the present invention has a purpose to provide an image forming apparatus capable of preventing a problem that a sheet interval is not sufficiently ensured during continuous printing due to disorderly supplied papers.

SUMMARY OF THE INVENTION

To achieve the above purpose, one aspect of the present invention provides an image forming apparatus including: a conveying section for performing a conveying action of conveying a sheet along a conveying path; a sheet loading section for loading a plurality of sheets to be supplied to the conveying path, the sheets being loaded with their rear ends not restricted in a conveying direction; a sheet feed roller located most upstream of the conveying section and configured to rotate to perform a feeding action of feeding a topmost one of the sheets loaded on the sheet loading section to the conveying path; and an image forming section for forming an image on the sheet conveyed through the conveying path, wherein the image forming apparatus includes: a conveyed sheet detection part for detecting presence or absence of the sheet on a detection point upstream of a position where an image is formed on the sheet by the image forming section on the conveying path; a conveyance amount counting part for counting a sheet conveyance amount indicating an amount of conveyance motion by the conveying section; a sheet interval control part for switching a sheet interval mode in a continuous printing job of continuously forming images on a plurality of sheets between a normal sheet interval mode for performing the feeding action such that a sheet interval between two successive sheets during the continuous printing job is a predetermined normal sheet interval and an extended sheet interval mode for performing the feeding action such that the sheet interval is an extended sheet interval longer than the normal sheet interval; and an arrival waiting control part for performing arrival waiting control when the sheet conveyance amount counted from start of the feeding action by the conveyance amount counting part reaches a feeding detection conveyance amount as a predetermined threshold value but the conveyed sheet detection part does not detect the sheet, the arrival waiting control including delaying a timing of starting image forming by the image forming section until the conveyed sheet detection part detects the sheet while continuing the feeding action, and the sheet interval control part is configured: to set the normal sheet interval mode as an initially setting mode, to maintain the normal sheet interval mode when the arrival waiting control is not carried out from start of the feeding action until detection of the sheet by the conveyed sheet detection part, or to switch the normal sheet interval mode to the extended sheet interval mode when the initially setting mode is not maintained.

The extended sheet interval in the extended sheet interval mode is made longer than the normal sheet interval in the normal sheet interval mode. In the normal sheet interval mode, continuous printing can be performed with higher productivity than in the extended sheet interval mode. Therefore, in a case that the arrival waiting control is not performed, it is preferable to perform the continuous printing in the normal sheet interval mode. On the other hand, in a case that the arrival waiting control is performed, there is a high possibility that a sheet which has already been conveyed on the way of the conveying path is present. It is therefore preferable to perform the continuous printing in the extended sheet interval mode after the arrival waiting control is performed. Thus, the continuous printing can be performed with ensuring the enough sheet interval between the sheet which has been conveyed on the way of the conveying path and the preceding sheet.

BRIEF DESCRIPTION OF THE DRAWINGS

FIG. 12 is a view showing a feeding result of continuous printing carried out in a state that there is a disorderly supplied paper;

DESCRIPTION OF EMBODIMENTS

First Embodiment

Figure 1:
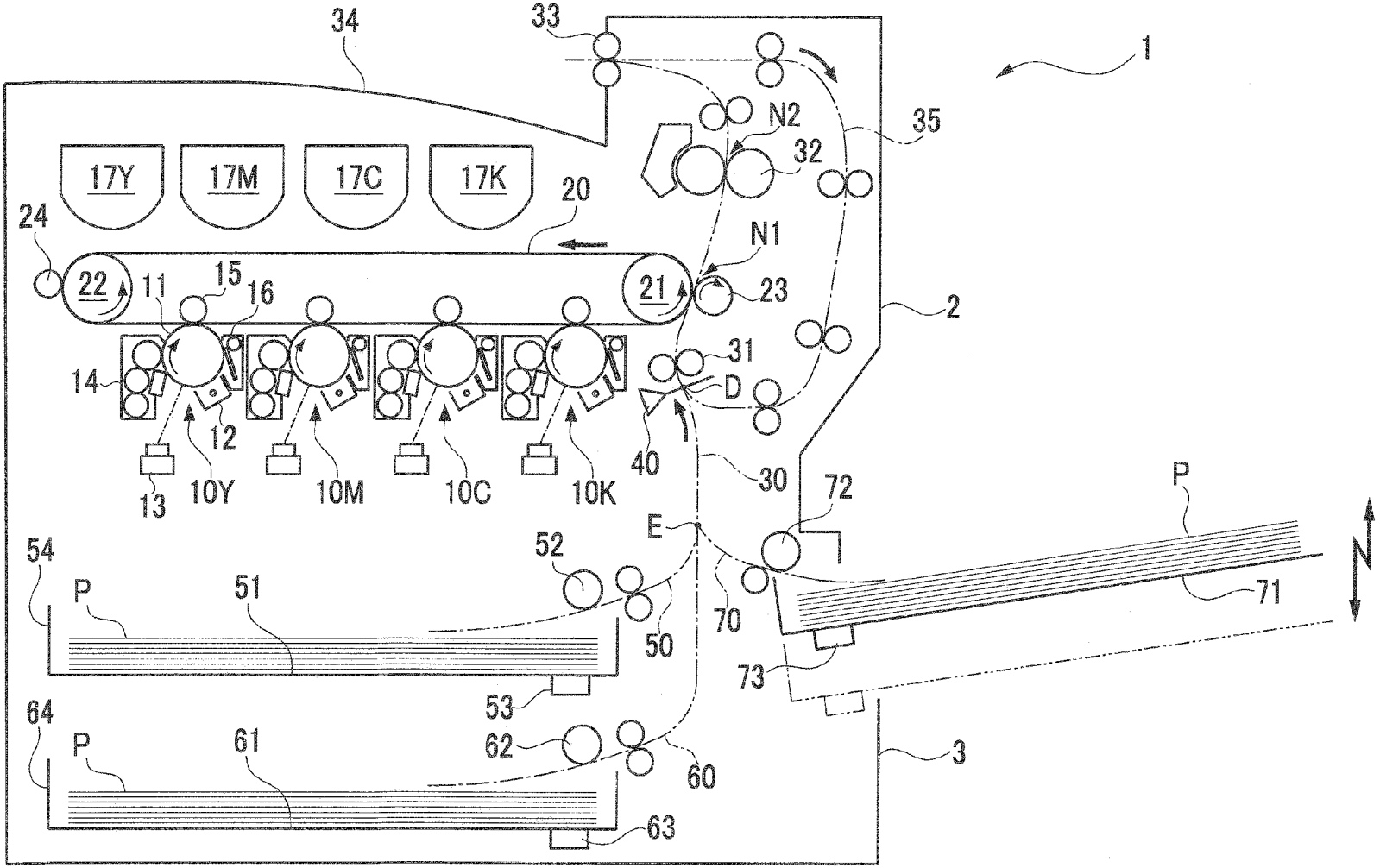
FIG. 1 is a schematic configuration view showing an image forming apparatus according to a first embodiment.

A detailed description of a preferred embodiment exemplifying the present invention will now be given referring to the accompanying drawings. FIG. 1 is a schematic configuration of an image forming apparatus 1 in the present embodiment. The image forming apparatus 1 includes an image forming section 2 configured to form an image on a sheet of paper P and a sheet feeding section 3 for supplying the paper P to the image forming section 2. The image forming apparatus 1 is a so-called tandem electrophotographic color printer including an intermediate transfer belt 20 inside the image forming section 2.

The intermediate transfer belt 20 is a conductive endless belt member, and is supported its both end portions in FIG. 1 by rollers 21 and 22. In image forming, the roller 21 on a right side in FIG. 1 is driven to rotate counterclockwise as indicated with an arrow in the figure. By this rotation of the roller 21, the intermediate transfer belt 20 and the roller 22 on a left side in FIG. 1 are driven to rotate in directions indicated with arrows in the figure.

In the intermediate transfer belt 20, on an outer circumferential surface of a portion supported by the roller 21 in the right side in FIG. 1, a secondary transfer roller 23 is provided. The secondary transfer roller 23 is press-contacted to the intermediate transfer belt 20 in a direction perpendicular to an axis (a leftward direction in FIG. 1). A portion where the intermediate transfer belt 20 and the secondary transfer roller 23 are contacted is constituted of a transfer nip N1 for transferring a toner image on the intermediate transfer belt 20 to the paper P. In image forming, the secondary transfer roller 23 is driven to rotate in a direction indicated with an arrow in FIG. 1 by a frictional force caused by press-contacting the roller 23 to the rotating intermediate transfer belt 20.

Further, in the intermediate transfer belt 20, on an outer circumferential surface of a portion supported by the roller 22 in the left side in FIG. 1, a belt cleaner 24 is provided. The belt cleaner 24 of the present embodiment is formed in a roller-like shape as shown in FIG. 1 and has a conductive brush on a surface of a core bar. As a conductive brush fiber, material types of nylon, polyester, acrylic, rayon, and others may be used. The belt cleaner 24 is for collecting a toner attached to a surface of the intermediate transfer belt 20. For example, the belt cleaner 24 collects a residual toner which is not transferred on the paper P by the transfer nip N1 and resides on the intermediate transfer belt 20 even after passing through the transfer nip N1.

Image forming units 10Y, 10M, 10C, and 10K for each color of yellow (Y), magenta (M), cyan (C), and black (K) are provided in this order from left to right below the intermediate transfer belt 20 in FIG. 1. Each one of the image forming units 10Y, 10M, 10C, and 10K is provided to form a toner image with respective color and to transfer the image on the intermediate transfer belt 20. Each of the image forming units 10Y, 10M, 10C, and 10K has the same configuration. Accordingly, in FIG. 1, only the image forming unit 10Y is given with reference signs on behalf of these four image forming units.

Each of the image forming units 10Y, 10M, 10C, and 10K has a photoconductor 11 as a cylindrical electrostatic latent image carrier, a charging unit 12, an exposing unit 13, a photographing unit 14, a primary transfer roller 15, and a photoconductor cleaner 16 which are placed around the photoconductor 11. The charging unit 12 is a device for uniformly charging a surface of the photoconductor 11. The exposing unit 13 is a device for irradiating a laser beam based on the image data with a corresponding color on the photoconductor 11 to form an electrostatic latent image. The photographing unit 14 is a device for applying the stored toner on the surface of the photoconductor 11.

The primary transfer roller 15 is positioned to face to the photoconductor 11 interposed with the intermediate transfer belt 20. The primary transfer roller 15 is press-contacted to the intermediate transfer belt 20 in a direction perpendicular to an axis (a downward direction in FIG. 1). By this press-contact, each portion where the intermediate transfer belt 20 and the photoconductors 11 are contacted is constituted of a primary transfer nip for transferring a toner image on the photoconductor 11 of each color to the intermediate transfer belt 20. The photoconductor cleaner 16 is provided for collecting the toner not transferred on the intermediate transfer belt 20 from the photoconductor 11.

In FIG. 1, the photoconductor cleaner 16 is illustrated in a plate-like shape and has one end portion being in contact with an outer circumferential surface of the photoconductor 11, but the present invention is not limited to this exemplification. As an alternative, other cleaning members such as a fixed brush, a rotating brush, a roller, and a combination of those plural members may be used. Alternatively, the photoconductor cleaner 16 may be omitted by applying a cleaner-less type of apparatus in which the photographing unit 14 collects untransferred toner remaining on the photoconductor 11.

Above the intermediate transfer belt 20 in FIG. 1, hoppers 17Y, 17M, 17C, and 17K are provided for storing each toner of the corresponding color. The toner with each color stored in the hoppers are appropriately supplied to the photographing units 14 of each color.

The image forming apparatus 1 of the present embodiment includes sheet feed cassettes 51 and 61 and a manual feeding tray 71 in the sheet feeding section 3 located below the image forming section 2. Each of the sheet feed cassettes 51 and 61 and the manual feeding tray 71 are loaded with a plurality of papers P. The paper P shown in FIG. 1 is a plain paper.

As shown in FIG. 1, in the right side of the cassettes 51 and 61 in FIG. 1, sheet feed rollers 52 and 62 configured to perform a feeding action to feed the paper P to sheet feed passages 50 and 60 are provided. In the left side of the manual feeding tray 71 in FIG. 1, a sheet feed roller 72 configured to perform a feeding action of feeding the paper P to a sheet feed passage 70 is provided. The sheet feed rollers 52, 62, and 72 are configured to feed a topmost one of the papers P loaded on the cassettes 51 and 61 and the manual feeding tray 71 to each of the sheet feed passages 50, 60, and 70. Namely, the sheet feed rollers 52, 62, and 72 are configured as conveying rollers positioned most upstream in the sheet feed passages 50, 60, and 70. Any one of the papers P fed to the sheet feed passages 50, 60, and 70 is conveyed to an image forming passage 30 downstream of a merging point E where the sheet feed passages 50, 60, and 70 are merged.

Further, the cassettes 51 and 61 and the manual feeding tray 71 are provided with empty sensors 53, 63, and 73 for detecting presence or absence of the paper P. The empty sensors 53, 63, and 73 are configured to detect emptiness of the paper P in each of the cassettes 51 and 61 and the manual feeding tray 71. The empty sensors 53, 63, and 73 are placed on lower portions of the cassettes 51 and 61 and the tray 71, and located on sides to which the sheet feed passages 50, 60, and 70 are connected. Specifically, the empty sensors 53, 63, and 73 have front end sides in a conveying direction as detection points of the paper P on the sheet cassettes 51 and 61 and the manual feeding tray 71.

In addition, the sheet feed cassettes 51 and 61 are provided with restriction plates 54 and 64 for restricting a rear-end side position of the loaded paper P. On the other hand, the manual feeding tray 71 is not provided with the one like the restriction plates 54 and 64 of the cassettes 51 and 61.

The manual feeding tray 71 of the present embodiment is allowed to move in an upper and lower direction in FIG. 1 to be positioned in a sheet feed enabling position and a separated position. The manual feeding tray 71 indicated with a solid line in FIG. 1 is in the sheet feed enabling position in which the paper P loaded on the manual feeding tray 71 is allowed to be fed to the sheet feed passage 70 by the feeding action of the sheet feed roller 72. On the other hand, the double-chained line in FIG. 1 indicates the manual feeding tray 71 in the separated position. When the manual feeding tray 71 is in the separated position, the paper P loaded on the manual feeding tray 71 is separated from the sheet feed roller 72.

On the image forming passage 30 through which the paper P fed from the sheet feeding section 3 passes, a pair of paper stop rollers 31, the transfer nip N1, a fixing unit 32, a discharge roller 33 are positioned in this order. On a further downstream side of the image forming passage 30, a discharge section 34 for discharging the paper P completed with image forming is provided. The paper stop rollers 31 are configured to minutely adjust timing of feeding the paper P to the transfer nip N1.

The fixing unit 32 of the present embodiment includes, as shown in FIG. 1, a pair of rollers press-contacted to each other. By this press-contact, a fixing nip N2 is constituted. The fixing unit 32 is configured to pass the paper P to the fixing nip N2 and to apply fixing work of heating and pressurizing the passing paper P. By this fixing work by the fixing nip N2, the toner image carried on the paper P can be fixed to the paper P.

The image forming apparatus 1 of the present embodiment includes, as shown in FIG. 1, a duplex conveying path 35. The duplex conveying path 35 is configured to convey the paper P which has once passed through the image forming passage 30 to the passage 30 again. Thus, the image forming apparatus 1 can form images on both sides of the paper P. Each one of the image forming passage 30, the sheet feed passages 50, 60, and 70, and the duplex conveying path 35 is the conveying path for conveying the paper P.

On an upstream position of the paper stop rollers 31 in the image forming passage 30, a sheet sensor 40 is provided. The sheet sensor 40 is configured to detect presence or absence of the paper P on a detection point D on the image forming passage 30. Namely, a state of detection by the sheet sensor 40 teaches detection of arrival or passing of the paper P on the detection point D. To be more concrete, a front end of the paper P can be detected when the detected state of the sheet sensor 40 is changed from absence to presence. When the detected state of the sheet sensor 40 is changed from presence to absence, a rear end of the paper P is detected. Other than the sheet sensor 40, sensors for detecting arrival and passing of the paper P are provided in portions on the conveying path.

Figure 2:
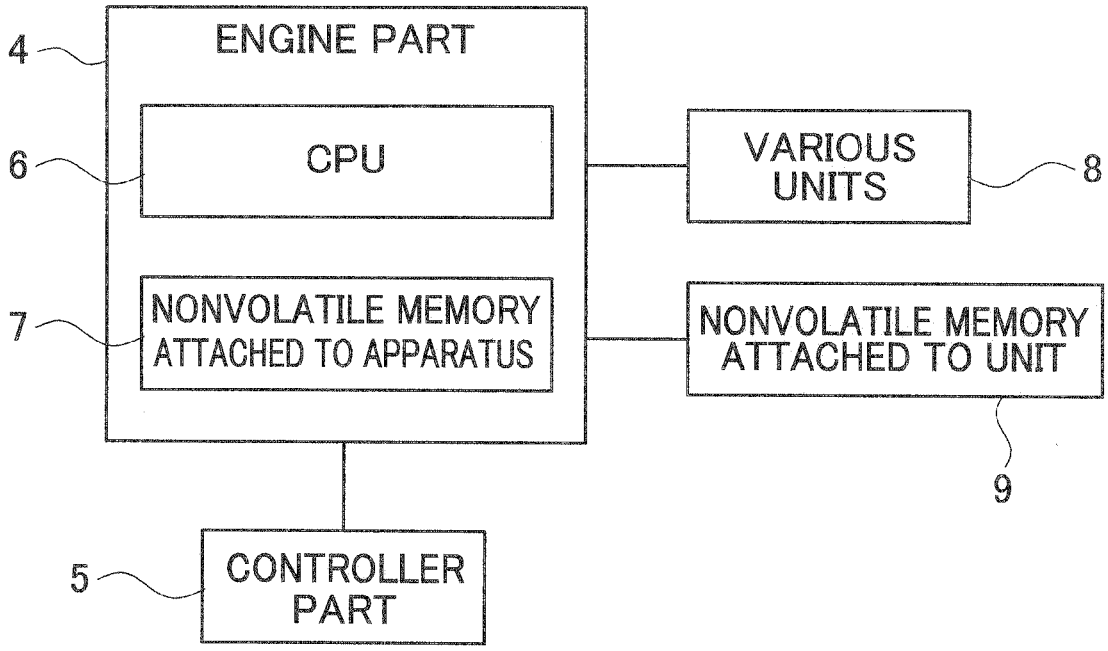
FIG. 2 is a schematic view showing a control configuration of the image forming apparatus according to the first embodiment.

FIG. 2 is a schematic view showing a control configuration of the image forming apparatus 1. The image forming apparatus 1 includes an engine part 4 and a controller part 5 for controlling each section of the apparatus. The engine part 4 includes a CPU 6 for the overall control processing and a nonvolatile memory 7 attached to the apparatus.

The nonvolatile memory 7 stores mechanical dimensions of the image forming apparatus 1 such as a distance from each of the sheet feed rollers 52, 62, and 72 to the detection point D of the sheet sensor 40. Further, for example, the nonvolatile memory 7 stores values such as rotation speed of the roller 21, rotation speed of each photoconductor 11, and system speed as a speed of conveying the paper P and the formed toner image. Furthermore, the nonvolatile memory 7 also stores a normal sheet interval, a sheet feeding detection time, a detection disregard time, and others which will be mentioned later.

The CPU 6 controls each section of the image forming apparatus 1 based on the values stored in the nonvolatile memory 7. For example, by adjusting timing of starting formation of an electrostatic latent image by each exposing unit 13, a color toner image with no misalignment is formed on the intermediate transfer belt 20. Moreover, the CPU 6 controls timing of forming an image by the image forming units 10Y, 10M, 10C, and 19K and timing of feeding the paper P by the sheet feeding section 3 so that entering timing of the paper P and the formed image into the transfer nip N1.

The CPU 6 further obtains the actual position of the conveyed paper P by the sensors provided in portions on the conveying path of the paper P such as the image forming passage 30. As mentioned above, it can be detected by the sheet sensor 40 whether or not the paper P has passed the detection point D. Accordingly, the CPU 6 can detect generation of jam of the paper P and others by comparing a target position of the paper P by controlling the conveyance and the actual position of the paper P obtained by the sensors provided along the conveying path.

Furthermore, the CPU 6 carries out feed retry control of feeding the paper P again when feeding the paper P is not properly performed from the manual feeding tray 71 by the feeding action of the sheet feed roller 72. The CPU 6 can also carry out reverse control of rotating the sheet feed roller 72 in a reverse direction from a rotation direction of feeding the paper P from the manual feeding tray 71. The CPU 6 of the present embodiment carries out the reverse control in a state that the manual feeding tray 71 is held in the separated position.

The image forming apparatus 1 of the present embodiment can perform the continuous printing of continuously forming images on the plurality of papers P with switching the normal sheet interval mode and the extended sheet interval mode. The CPU 6 is in charge of switching the sheet interval mode in the continuous printing. These controls of the feed retry control, the reverse control, the normal sheet interval mode, and the extended sheet interval mode will be explained in detail below.

The engine part 4 configured to control various units 8 included in the image forming apparatus 1 and to write to and read out from a nonvolatile memory 9 attached to each of the various units. The various units 8 include, for example, a toner bottle and an imaging unit. In the nonvolatile memory 9 attached to the various units, for example, residual amount of toner is stored in a memory attached to the toner bottle and number of printed papers is stored in a memory attached to the imaging unit.

The controller part 5 is connected to an exterior personal computer and others to receive input commands. For instance, the image forming apparatus 1 takes an image forming job by receiving a command of image forming from a personal computer. Then, the engine part 4 and the controller part 5 give and take various information such as a dot counter value.

Next, one example of a normal image forming action by the image forming apparatus 1 of the present embodiment is briefly explained. The following explanation is made with an example of an image forming action in color mode for forming a color image by toners with four colors on the paper P loaded on the manual feeding tray 71.

In normal color image forming, the intermediate transfer belt 20 and the photoconductors 11 with each color are rotated at a predetermined circumferential speed in a direction indicated with arrows in FIG. 1. Then, an outer circumferential surface of each of the photoconductors 11 is uniformly charged by the charging unit 12. Thus charged outer circumferential surface of the photoconductor 11 is irradiated with a beam corresponding to an image data by the exposing unit 13, and an electrostatic latent image is formed. Then, the electrostatic latent image is developed by the developing unit 14 to form a toner image on the photoconductor 11. The toner image with each color is transferred on the intermediate transfer belt 20 (primary transfer) by the primary transfer nip constituted by the photoconductor 11 and the intermediate transfer belt 20. Namely, on the intermediate transfer belt 20, toner images of yellow (Y), magenta (M), cyan (C), and black (K) are overlapped in this order.

Residual toner, which is not transferred on the intermediate transfer belt 20 and remaining on the photoconductor 11 even after passing through the primary transfer toner 15, is scraped by the photoconductor cleaner 16 and removed from the photoconductor 11. Then, the overlapped four-colored toner image is conveyed to the transfer nip N1 by rotation of the intermediate transfer belt 20.

The paper P loaded on the manual feeding tray 71 is taken out to the sheet feed passage 70 one by one from the topmost one by the feeding action of the sheet feed roller 72. The feeding action of the sheet feed roller 72 is performed while the manual feeding tray 71 is in the sheet feed enabling position. The feeding action is, naturally, started while the paper P is loaded on the manual feeding tray 71. Whether or not the paper P is loaded on the manual feeding tray 71 is detected by the empty sensor 73.

The paper P taken out from the manual feeding tray 71 is conveyed to the transfer nip N1 along the sheet feed passage 70 and the image forming passage 30. An entering timing of the paper P to the transfer nip N1 is usually minutely adjusted by the paper stop rollers 31 so as to coincide this paper P's entering timing with the entering timing of the toner image on the intermediate transfer belt 20 into the transfer nip N1. In this manner, on the transfer nip N1, the four-colored toner image is transferred to the paper P (secondary transfer).

The paper P transferred with the toner image is further conveyed to the downstream side of the image forming passage 30. Specifically, after the paper P is fixed with the toner image by passing through the fixing nip N2, the paper P is discharged to the discharge section 34 by the discharge roller 33. The transfer residual toner remaining on the intermediate transfer belt 20 after passing through the transfer nip N1 is collected by the belt cleaner 24. Thus, the residual toner is removed from the intermediate transfer belt 20.

In the continuous printing of continuously forming images on the plurality of papers P, the image forming apparatus 1 carries out the above image forming action continuously with fixed intervals. Accordingly, the feeding action of feeding the paper P is also carried out with fixed intervals so that the paper P is inserted in the transfer nip N1 with fixed intervals.

When performing duplex printing on the paper P, the paper P is formed on one side with an image by passing through the image forming passage 30, and then front and back sides of the paper P are turned round by the discharge roller 33 and the paper P is conveyed to the duplex conveying path 35. The paper P having passed the duplex conveying path 35 is conveyed to the image forming passage 30 again. Thus, an image can be formed on the other side from the side on which the image has already been formed. The paper P formed on both sides with images is then discharged to the discharge part 34.

Figure 3:
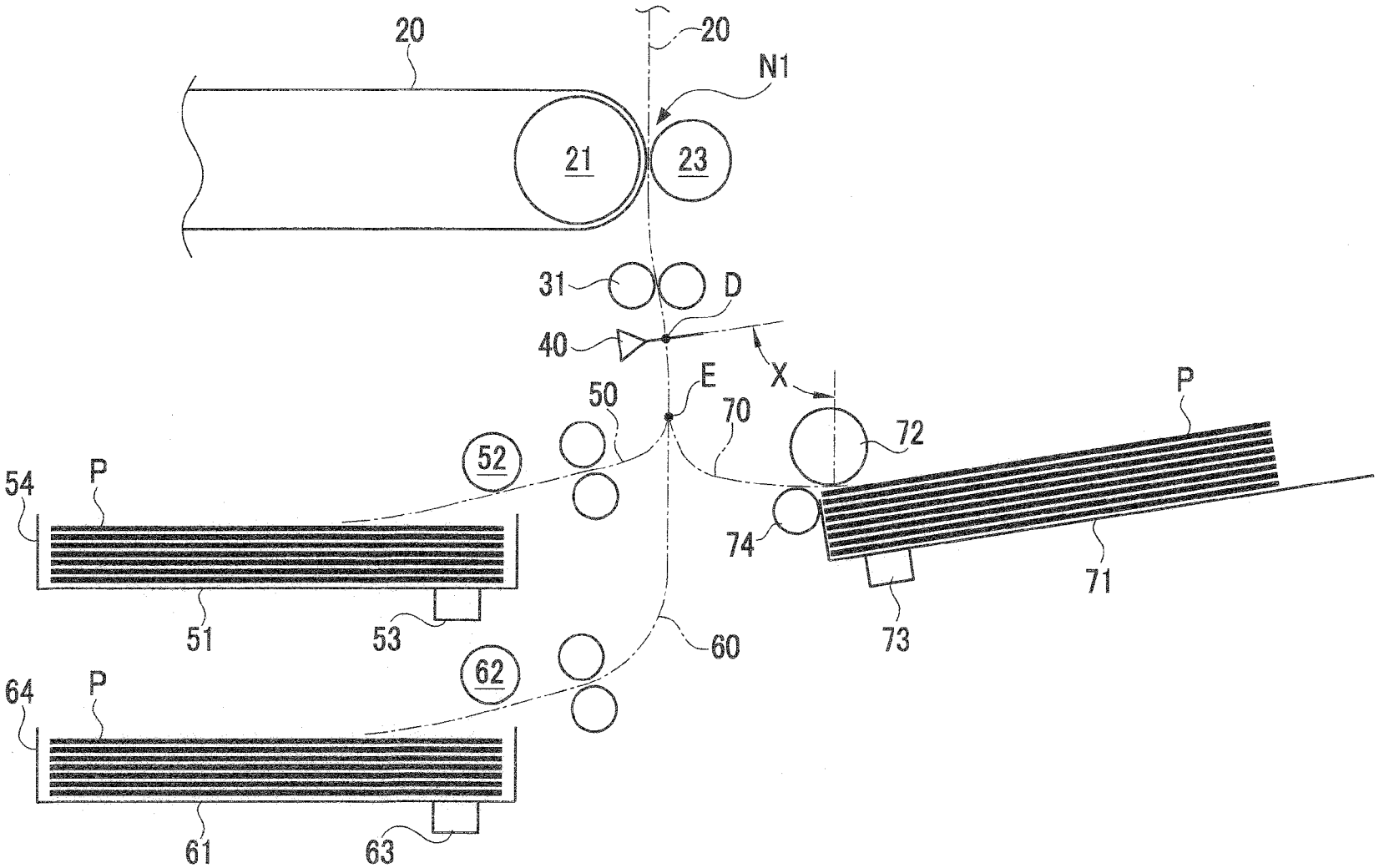
FIG. 3 is a view for explaining a feed retry control.

The feed retry control is now explained. FIG. 3 is a partial configuration showing the sheet feed cassettes 51 and 61 and the manual feeding tray 71 to the transfer nip N1 of the image forming apparatus 1. As shown in FIG. 3, in the manual feeding tray 71, a separating roller 74 is provided in a portion facing to the sheet feed roller 72. The separating roller 74 is provided to prevent multi-feeding of feeding the plurality of papers P to the sheet feed passage 70 by the feeding action of the sheet feed roller 72. The separating roller 74 of the present embodiment is a roller provided with torque limiter.

Specifically, when only one piece of paper P is fed by the feeding action, the separating roller 74 is driven to rotate by the friction with the paper. However, when the multi-feeding occurs and the plurality of papers P are present between the sheet feed roller 72 and the separating roller 74, the roller 74 is applied with load so as not to rotate. Therefore, when the multi-feeding occurs by the feeding action, only the topmost paper P which is in contact with the sheet feed roller 72 is fed to the sheet feed passage 70. Also in FIG. 3, a distance from the sheet feed roller 72 to the detection point D of the sheet sensor 40 on the conveying path of the paper P is indicated as a feeding detection distance X.

The feed retry control of the present embodiment is to once stop the feeding action of the paper P when it is concluded that feeding failure occurs and to restart the feeding action again. The feed retry control of the present embodiment is performed for the sheet feed roller 72 of the manual feeding tray 71. Unlike the sheet feed cassettes 51 and 61, the manual feeding tray 71 has high possibility of being loaded with, not only the plain paper P, but also envelopes and special papers. Therefore, the manual feeding tray 71 is, for example, apt to generate feeding failure of generating a slip between the sheet feed roller 72 having started the feeding action and the paper P. By performing the feed retry control, there is a chance of solving the feeding failure such as the slip.

The feed retry control is performed when the paper P does not arrives at the detection point D by the time when a sheet feeding detection time has elapsed since the feeding action by the sheet feed roller 72 has started. The sheet feeding detection time is a predetermined period of time determined based on the feeding detection distance X and the conveyance speed of the paper P. Namely, the sheet feeding detection time of the present embodiment is a period of time when the paper P is appropriately conveyed through the sheet feed passage 70 and the image forming passage 30 by the feeding detection distance X without generating jam and others.

When the paper P contacted with the sheet feed roller 72 is properly fed by the feeding action of the sheet feed roller 72 and properly conveyed to the detection point D, the front end of the paper P arrives at the detection point D within a period of time when the sheet feeding detection time has elapsed since the feeding action has started. On the other hand, when there is the feeding failure such as the slip, the paper P is not properly fed from the manual feeding tray 71 even though the feeding action is performed. When the paper P is not properly fed due to the feeding failure such as the slip, the paper P sometimes fails to reach the detection point D within the period of time that the sheet feeding detection time has elapsed since the feeding action has started.

In response to this, the CPU 6 of the present embodiment starts counting the period of time when the sheet feed roller 72 has started the feeding action. Then, in a case that the paper P does not reach the detection point D by the time when the counted time reaches the sheet feeding detection time, the feed retry control is carried out. When the paper P is properly fed by the feed retry control, the paper P passes through the detection point D and the image is formed on the paper P. As a result, even when the feeding failure such as the slip occurs in an initial feeding action, the image forming can be performed without stopping the image forming apparatus 1 by performing the feed retry control.

In a case that the paper P cannot be properly fed even by the feed retry control, the feed retry control may be performed again. Alternatively, generation of feeding failure of the paper P on the manual feeding tray 71 may be informed to a user. In this case, the image forming apparatus 1 provided with a display panel can inform the feeding failure to the user by this display panel. Alternatively, the feeding failure may be informed by an alarm and lighting of a lamp.

The feed retry control may be performed based on, instead of the time since the start of the feeding action by the sheet feed roller 72, a rotation amount of each conveyance roller conveying the paper P. A distance of properly conveying the paper P is, for example, obtained by the rotation amount of the conveyance rollers such as the sheet feed roller 72 positioned in portions on the conveying path. In other words, the rotation amount of each conveyance roller corresponding to the sheet feeding detection distance X is determined in advance as a sheet feeding detection rotation amount. Then, the CPU 6 may carry out the feed retry control when the paper P does not arrive at the detection point D while the rotation amount of each conveyance roller counted since the start of the feeding action of the sheet feed roller 72 reaches the sheet feeding detection rotation amount.

Alternatively, the sheet feeding detection time and the sheet feeding detection rotation amount may be determined based on a distance not only by the feeding detection distance X but also by a distance longer than the sheet feeding detection distance X. Namely, the sheet feeding detection time or the feeding detection rotation amount may be determined as the time or the rotation amount of each conveyance roller when the paper P is properly conveyed by a distance longer than the feeding detection distance X along the sheet feed passage 70 and the image forming passage 30 without generating jam and others.

Further, instead of the feed retry control of retrying the feeding action, feeding action continuous control may be performed in such a way of, without stopping the feeding action by the sheet feed roller 72, continuously performing the feeding action by the sheet feed roller 72 over the sheet feeding detection time and the sheet feeding detection rotation amount. Furthermore, for example, in the feed retry control, the sheet feed roller 72 may be rotated at a rotation speed slower than the rotation speed of the feeding action before the feed retry control. By slowing down the rotation speed of the sheet feed roller 72, frequency of generation of slip can be lowered.

Those feed retry control and feeding action continuous control are both the arrival waiting control of waiting for the arrival of the paper P at the detection point D when the arrival of the paper P at the detection point D in sheet feeding is delayed. Even when the arrival waiting control is carried out, the toner image starts to be formed on each of the image forming units 10Y, 10M, 10C, and 10K. Therefore, when the arrival waiting control is carried out to the paper P to be transferred with the image, the arrival of the formed toner image at the transfer nip N1 is controlled to be delayed. Specifically, it is conceived that the rotation speeds of the intermediate transfer belt 20 and the photoconductors 11 are delayed. Alternatively, rotation of the intermediate transfer belt 20 and the photoconductor 11 may be temporarily stopped.

Next, the normal sheet interval mode and the extended sheet interval mode for the continuous printing by the image forming apparatus 1 is explained. In the image forming apparatus 1 of the present embodiment, both the normal sheet interval mode and the extended sheet interval mode are modes for carrying out the continuous printing to the papers P loaded on the manual feeding tray 71.

The normal sheet interval mode is the mode for carrying out the feeding action by the sheet feed roller 72 such that a sheet interval between the successive papers P is as short as possible. Thus, productivity of image forming can be enhanced in the normal sheet interval mode. On the other hand, the extended sheet interval mode is set to perform the feeding action by the sheet feed roller 72 such that the sheet interval is longer than the normal sheet interval. Usually, it is preferable to perform the continuous printing in the normal sheet interval mode so as to put a priority on the productivity of image forming. Therefore, in an initial setting by turning on the image forming apparatus 1, the mode is set in the normal sheet interval mode.

Figure 4:
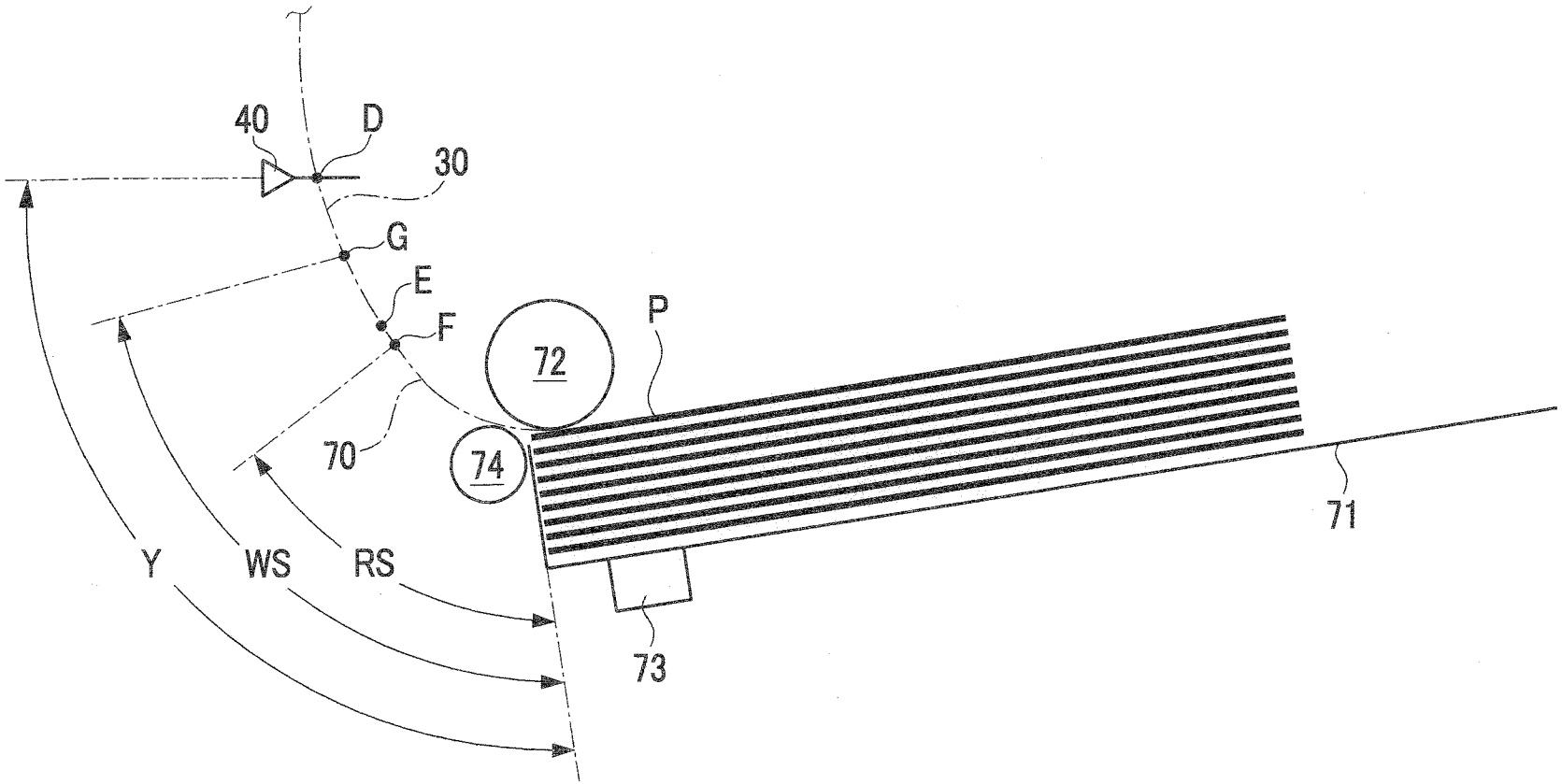
FIG. 4 is a view for explaining a normal sheet interval mode and an extended sheet interval mode.

FIG. 4 is a view for explaining the normal sheet interval mode and the extended sheet interval mode. In FIG. 4, as an interval between the successive papers P for continuous printing, a normal sheet interval RS in the normal sheet interval mode and an extended sheet interval WS in the extended sheet interval mode are shown. In the normal sheet interval mode, when a rear end of the fed paper P reaches a point indicated with a reference F in FIG. 4 by conveyance, the sheet feed roller 72 is driven to start a feeding action for the following paper P. In the extended sheet interval mode, when the rear end of the fed paper P reaches a point indicated with a reference G in FIG. 4 by conveyance, the sheet feed roller 72 is driven to start the feeding action for the following paper P.

In the present embodiment, both the normal sheet interval RS and the extended sheet interval WS are made to be shorter than a distance Y from a front end of the paper P properly loaded on the manual feeding tray 71 to the detection point D of the sheet sensor 40. Consequently, as long as jam and others do not occur in both the normal sheet interval mode and the extended sheet interval mode, the feeding action of the following paper P is started before the rear end of the preceding paper P for the continuous printing passes the detection point D.

Herein, supply of the paper P to the sheet feed cassettes 51 and 61 and the manual feeding tray 71 is made by a user of the apparatus. When supplying the papers, as for the manual feeding tray 71, the papers P are apt to be loaded disorderly compared to the sheet feed cassettes 51 and 61. This is because the manual feeding tray 71 is not provided with an element such as restriction plates 54 and 64 for restricting the rear end of the paper P of the sheet feed cassettes 51 and 61.

Further, as for the manual feeding tray 71, in a state that the papers P have already been loaded, additional papers P are apt to be supplied above those papers P loaded on the tray 71. This is because the tray 71 is exposed outside the apparatus unlike the cassettes 51 and 61. Then, the paper P disorderly added on the manual feeding tray 71 is sometimes positioned not to be in contact with the sheet feed roller 72. Specifically, the manual feeding tray 71 is apt to be in a state shown in FIG. 5 due to the disorderly loaded paper P.

Figure 5:
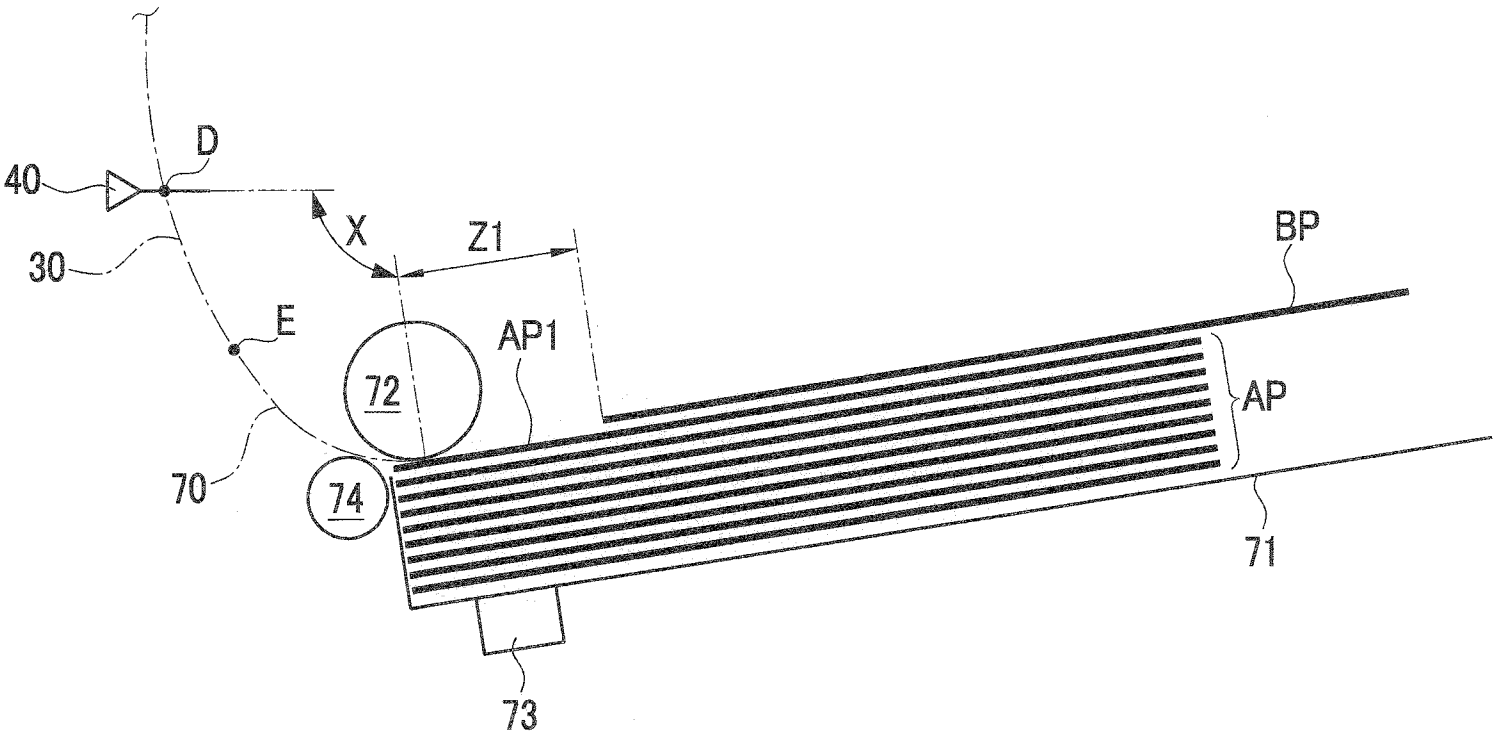
FIG. 5 is a view for explaining a state that a paper is supplied disorderly on properly loaded papers.

In FIG. 5, only one added paper P is shown as an additional paper BP. The additional paper BP in FIG. 5 is supplied with its front end placed apart from the sheet feed roller 72. A distance from the front end of the additional paper BP supplied apart from the sheet feed roller 72 to the sheet feed roller 72 is indicated with a reference Z1 in FIG. 5. Further, in FIG. 5, a sheaf of papers which have been properly loaded on the manual feeding tray 71 before supplying the additional paper BP is indicated as a sheaf of initial papers AP. In addition, a topmost paper P of the sheaf of initial papers AP is indicated as a first initial paper AP1 in FIG. 5.

In the image forming apparatus 1 of the present embodiment, supply of the additional paper BP to the manual feeding tray 71 cannot be detected since an element such as a sensor for detecting the additional paper BP is not provided. The empty sensor 73 is provided for detecting the lowest one of the sheaf of initial papers AP and therefore the sensor 73 is not able to detect the additional paper BP. As shown in FIG. 5 and others, the manual feeding tray 71 of the present embodiment is arranged to be inclined so that one side closer to the sheet feed roller 72 is located lower than the other side of the tray. However, this inclination angle of the tray 71 is not so steep to make a slip on the additional paper BP to move toward the sheet feed roller 72 by its gravity.

When the feeding action is performed from the manual feeding tray 71 and an image is formed, the first initial paper AP1 firstly starts to be fed since the first initial paper AP1 is the one which is in contact with the sheet feed roller 72. According to feeding of the first initial paper AP1, the additional paper BP placed above the paper AP1 is also moved toward the sheet feed roller 72. This is because there is friction between an upper surface of the first initial paper AP1 and a lower surface of the additional paper BP.

Figure 6:
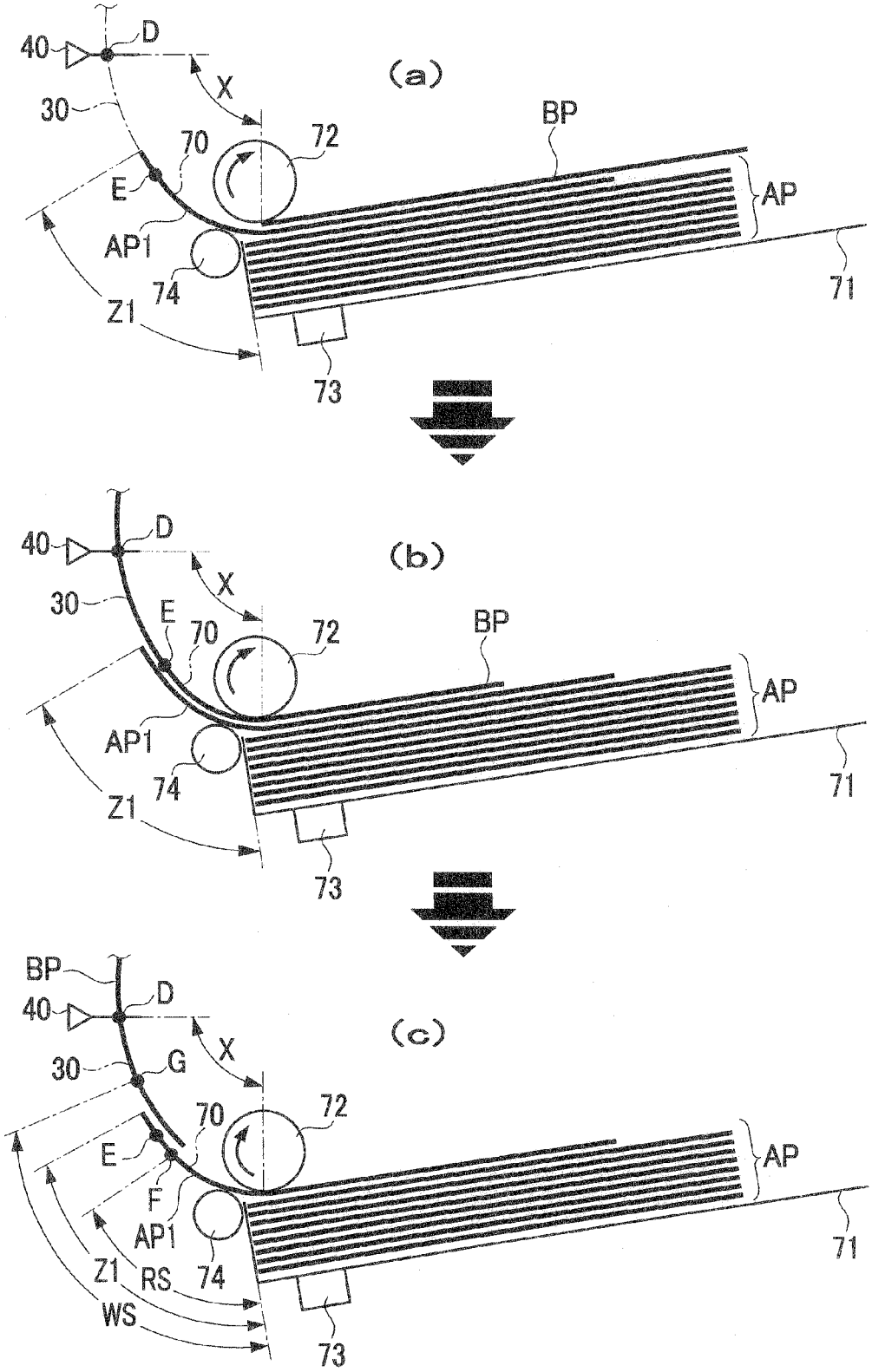
FIG. 6 is a view for explaining a case of multi-feeding because feeding is performed in a state that there is a paper disorderly supplied.

FIG. 6 is a view for explaining movement of the first initial paper AP1 and the additional paper BP when the feeding action is carried out in the state shown in FIG. 5. As mentioned above, when the feeding action is started in the state of FIG. 5, the first initial paper AP1 which is in contact with the sheet feed roller 72 is fed. Then, when the first initial paper AP1 is fed by the distance Z1 from a front end of the supplied additional paper BP to the sheet feed roller 72, the front end of the additional paper BP reaches the sheet feed roller 72. As shown in FIG. 6 (*a*), the first initial paper AP1 is fed by the distance Z1 when the front end of the additional paper BP reaches the sheet feed roller 72.

When the feeding action is further continued from the state shown in FIG. 6 (*a*), in FIG. 6 (*b*), the additional paper BP contacted with the sheet feed roller 72 starts to be fed. In the state shown in FIG. 6 (*b*), the fed additional paper BP passes the detection point D.

Herein, in the state of FIG. 5 that the feeding action is started, in a period of time from the state of FIG. 6 (*a*) to the state of FIG. 6 (*b*), the feed retry control is carried out. After starting the feeding action in the state of FIG. 5, the paper firstly passing through the detection point D is the additional paper BP. The front end of the additional paper BP at the start of the feeding action is placed apart from the detection point D by the distance of adding the distance Z1 from the sheet feed roller 72 to the feeding detection distance X in the state shown in FIG. 5. Accordingly, in a case that the feeding action is started while the additional paper BP is supplied as shown in FIG. 5, the period of time from the start of the feeding action to the arrival of the front end of the additional paper BP at the detection point D is longer than the sheet feeding detection time.

After the additional paper BP in FIG. 6 (*a*) reaches the sheet feed roller 72, the first initial paper AP1 is not in contact with the sheet feed roller 72, but a lower surface of the first initial paper AP1 is in contact with a separating roller 74. Thus, the first initial paper AP1 is in a stop state at the position when the additional paper BP reaches the sheet feed roller 72. In FIG. 6, the first initial paper AP1 is stopped its feeding at a position where the front end of the paper AP1 is fed downstream from the merging point E. When the feeding action is further continued in the state of FIG. 6 (*b*), the additional paper BP is conveyed through the image forming passage 30 as shown in FIG. 6 (*c*). As a result, an image is formed on a surface of the additional paper BP.

In a case of performing the continuous printing job of image forming while the additional paper BP shown in FIG. 5 is supplied, the first initial paper AP1 is the one to be fed by the feeding action after feeding the additional paper BP. After the additional paper BP has passed the sheet feed roller 72, the first initial paper AP1 is the one being in contact with the sheet feed roller 72. At the start of the feeding action, the first initial paper AP1 starts to be fed from the position where the paper AP1 has been fed from the manual feeding tray 71 by the distance Z1 as shown in FIG. 6 (*c*).

Further, FIG. 6 (*c*) shows the state the rear end of the additional paper BP is fed to the position F of the normal sheet interval RS. Namely, when the mode for continuous printing is set in the normal sheet interval mode, the following feeding action is started in the state shown in FIG. 6 (*c*). Further as shown in FIG. 6 (*c*), the distance Z1 by which the first initial paper AP1 has been fed from the manual feeding tray 71 is made longer than the normal sheet interval RS. In the state shown in FIG. 6 (*c*), the first initial paper AP1 has been conveyed its front end downstream from the position F of the normal sheet interval RS.

Accordingly, when the mode for continuous printing is set in the normal sheet interval mode in FIG. 6 (*c*), the additional paper BP and the first initial paper AP1 are fed to the image forming passage 30 in a state that the rear end side of the additional paper BP and the front end side of the first initial paper AP1 are overlapped. Accordingly, in this case, the sheet sensor 40 cannot detect passing of the rear end of the additional paper BP and arrival of the front end of the first initial paper AP1. As a result, in the image forming apparatus 1, a size of the additional paper BP fed from the manual feeding tray 71 could be wrongly detected. Further, the image forming apparatus 1 could wrongly detect jam of the additional paper BP and the first initial paper AP1, so that the apparatus 1 could be stopped. Moreover, when the additional paper BP and the first initial paper AP1 are overlapped, images cannot be properly formed on those papers.

In response to this, the image forming apparatus 1 of the present embodiment carries out the continuous printing in the extended sheet interval mode when it is considered that the first initial paper AP1 has already been conveyed from the manual feeding tray 71 as shown in FIG. 6 (*c*). As shown in FIG. 6 (*c*), the distance Z1 of which the first initial paper AP1 has already been fed from the manual feeding tray 71 is shorter than the extended sheet interval WS. Specifically, in the state shown in FIG. 6 (*c*), the front end of the first initial paper AP1 is placed upstream from a position G of the extended sheet interval WS. Accordingly, by performing the continuous printing in the extended sheet interval mode, it is possible to prevent feeding the additional paper BP and the first initial paper AP1 in an overlapped state. This is because the feeding action of the first initial paper AP1 is started when the rear end of the additional paper BP reaches the position G of the extended sheet interval WS. Thereby, image forming on the additional paper BP and the first initial paper AP1 can be properly performed.

Figure 7:
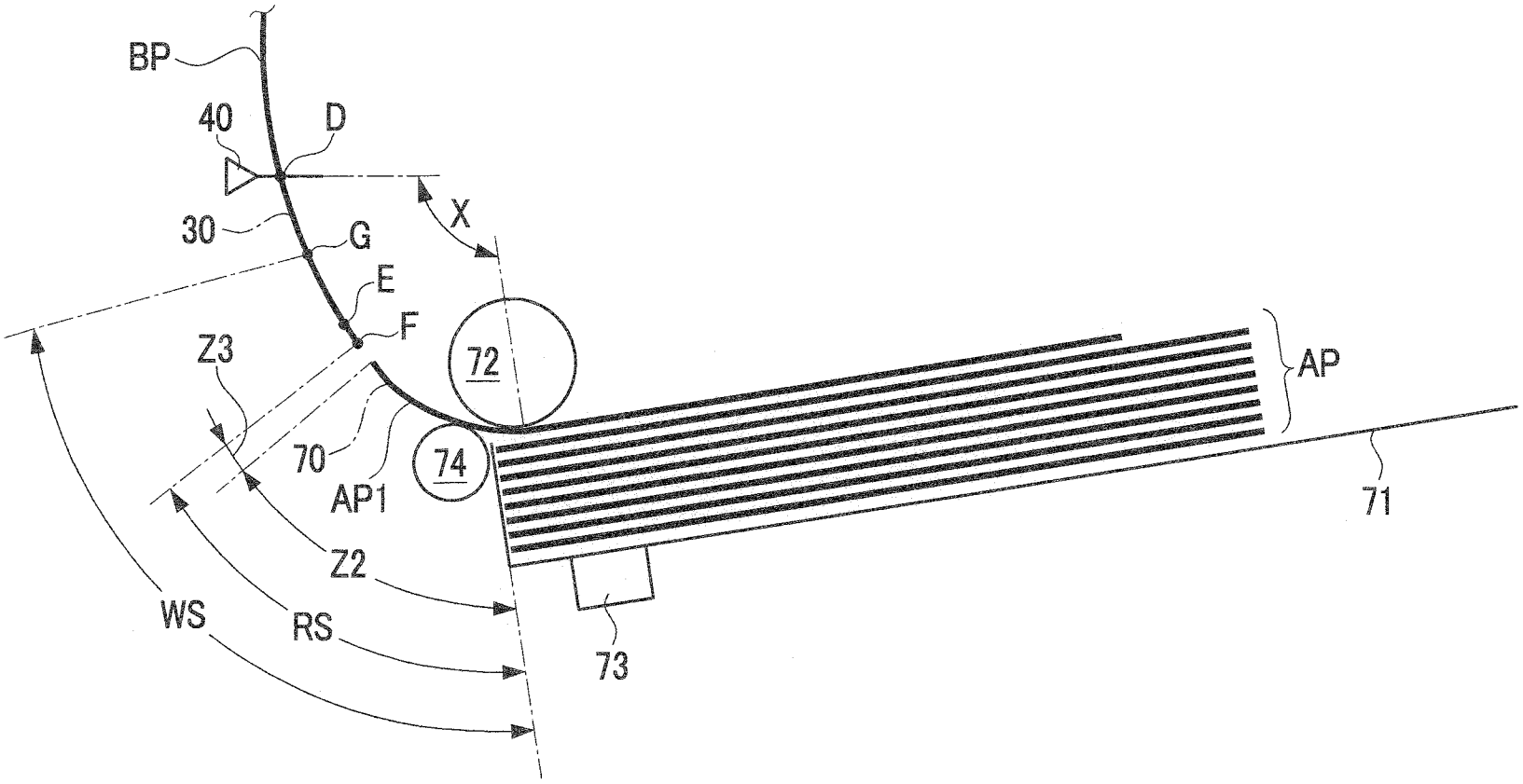
FIG. 7 is a view for explaining a case that a sheet interval is not sufficiently ensured because feeding is performed in a state that there is the paper disorderly supplied.

FIG. 6 illustrates an example that the distance Z1 of which the first initial paper AP1 has already been fed from the manual feeding tray 71 is longer than the normal sheet interval RS. On the other hand, FIG. 7 illustrates another example that the distance of which the first initial paper AP1 has already been fed from the manual feeding tray 71 is shorter than the normal sheet interval RS. FIG. 7 shows a state that the rear end of the additional paper BP has been fed to the position F of the normal sheet interval RS.

In FIG. 7, a distance of which the first initial paper AP1 has been conveyed from the manual feeding tray 71 is indicated as a distance Z2. As shown in FIG. 7, the distance Z2 is shorter than the normal sheet interval RS. In a state shown in FIG. 7, the front end of the first initial paper AP1 is positioned slightly upstream from the position F of the normal sheet interval RS.

Accordingly, when the continuous printing is performed in the normal sheet interval mode in the state shown in FIG. 7, the additional paper BP and the first initial paper AP1 are not overlapped. This is because there is a clearance Z3 between the rear end of the additional paper BP and the front end of the first initial paper AP1 as shown in FIG. 7.

However, the sheet sensor 40 usually carries out erroneous detection prevention control for preventing misdetection of the paper P due to chattering. Specifically, in the erroneous detection prevention control, the sheet sensor 40 disregards a detection state of sheet absence in a case that a period of time of absence is within the predetermined detection disregard period. In this manner, misdetection of the front and rear ends of the paper P is prevented when the detected state of the sensor 40 is changed from presence to absence and further changed to presence.

The clearance Z3 is made extremely short, and therefore it is a really short period of time since the rear end of the additional paper BP has passed the detection point D until the front end of the first initial paper AP1 reaches the detection point D. Namely, during the erroneous detection prevention control, there is a possibility that the sheet sensor 40 cannot detect the rear end of the additional paper BP and the front end of the first initial paper AP1. In a case that the rear end of the additional paper BP and the front end of the first initial paper AP1 cannot be detected, similar to the case shown in FIG. 6 (*c*), there is a possibility of erroneously detecting wrong size or jam of the paper. Accordingly, when the erroneous detection prevention control is performed even if the distance Z2 by which the first initial paper AP1 in FIG. 7 has already been fed from the manual feeding tray 71 is shorter than the normal sheet interval RS, it is not preferable to carry out the continuous printing in the normal sheet interval mode. Instead, it is preferable to carry out the continuous printing in the extended sheet interval mode.

The extended sheet interval WS in the extended sheet interval mode may be a distance of adding the distance Z1 to the normal sheet interval RS. The distance Z1 is the distance that the first initial paper AP1 has already been conveyed from the manual feeding tray 71. In the following description, the distance Z1 is also called as an initial paper projecting distance. The sheet feed roller 72 is controlled to perform the feeding action such that the sheet interval is as long as the sum of the normal sheet interval RS and the initial paper projecting distance Z1, and accordingly, the feeding is carried out such that the sheet interval between the rear end of the additional paper BP and the front end of the first initial paper AP1 is the normal sheet interval RS.

The initial paper projecting distance Z1 is obtained by a rotation period of the sheet feed roller 72, for example. As shown in FIG. 5, when the paper BP is conveyed by the sum of the feeding detection distance X and the distance Z1, the front end of the additional paper BP reaches the detection point D. In the present embodiment, the additional paper BP is moved in the initial feeding action during the sheet feeding detection time before performing the feed retry control from the supplied position to the detection point D by the feeding detection distance X from the supplied position. The paper BP is further moved by the distance Z1 and reaches the detection point D by the feeding action according to the feed retry control. Herein, the initial paper projecting distance Z1 is an extra distance additionally conveyed by the feed retry control, the extra distance being added to the feeding detection distance X in the initial feeding action before the feed retry control.

The feeding detection distance X and a diameter and the rotation speed of the sheet feed roller 72 are known values for designing. Consequently, the initial paper projecting distance Z1 can be obtained by a rotation period of the sheet feed roller 72 rotating from start of the initial feeding action before the feed retry control to feed the paper by the feeding detection distance X to arrival of the additional paper BP at the detection point D. Further, the distance Z1 may be obtained by a rotation amount of the sheet feed roller 72 rotating from start of the initial feeding action before the feed retry control to feed the paper by the feeding detection distance X to arrival of the additional paper BP at the detection point D.

Further, in the extended sheet interval mode, the feeding action of the following paper P may be carried out after the rear end of the preceding paper P passes the detection point D. This is because by performing the feeding action of the following paper P after the preceding paper P passes the detection point D, the sheet interval for the continuous printing can be ensured.

Next, a reverse control is explained. As mentioned above, the reverse control is performed by rotating the sheet feed roller 72 in a reverse direction from a rotating direction at the sheet feeding action while the manual feeding tray 71 is held in the separated position.

In the state of FIG. 6 (*c*), for example, the first initial paper AP1 has been conveyed by the initial paper projecting distance Z1. In a case that image forming on the additional paper BP is the last image forming job, it is preferable to carry out the reverse control. Unless the reverse control is performed, the first initial paper AP1 remains to be in a position conveyed by the initial paper projecting distance Z1 shown in FIG. 6 (*c*) until the next feeding action by the sheet feed roller 72 is started. As a result, when it takes long period of time to start the feeding action of the next image forming job from the sheet feed roller 72, there is a possibility of generating a curl and others on the first initial paper AP1.

In the state shown in FIG. 6 (*c*), the front end of the first initial paper AP1 has been conveyed to the image forming passage 30 downstream from the merging point E. Namely, if the next job is to form images on the papers on the sheet feed cassettes 51 and 61, the first initial paper AP1 could obstruct conveyance of the paper P conveyed from the sheet feed cassettes 51 and 61 to the image forming passage 30. Specifically, if the reverse control is not carried out, jam could be generated. Therefore, in the present embodiment, the first initial paper AP1 is returned to the manual feeding tray 71 by the reverse control in order to prevent curl and jam of the first initial paper AP1.

In addition, in the reverse control performed after the state shown in FIG. 6 (*c*), for example, the sheet feed roller 72 may be rotated reversely to feed the first initial paper AP1 to the manual feeding tray 71 by the distance equal to or longer than the initial paper projecting distance Z1. As mentioned above, the initial paper projecting distance Z1 can be obtained by the rotation period or the rotation amount of the sheet feed roller 72 since the initial feeding action is started to feed the paper by the feeding detection distance X until the additional paper BP reaches the detection point D.

Figure 8:
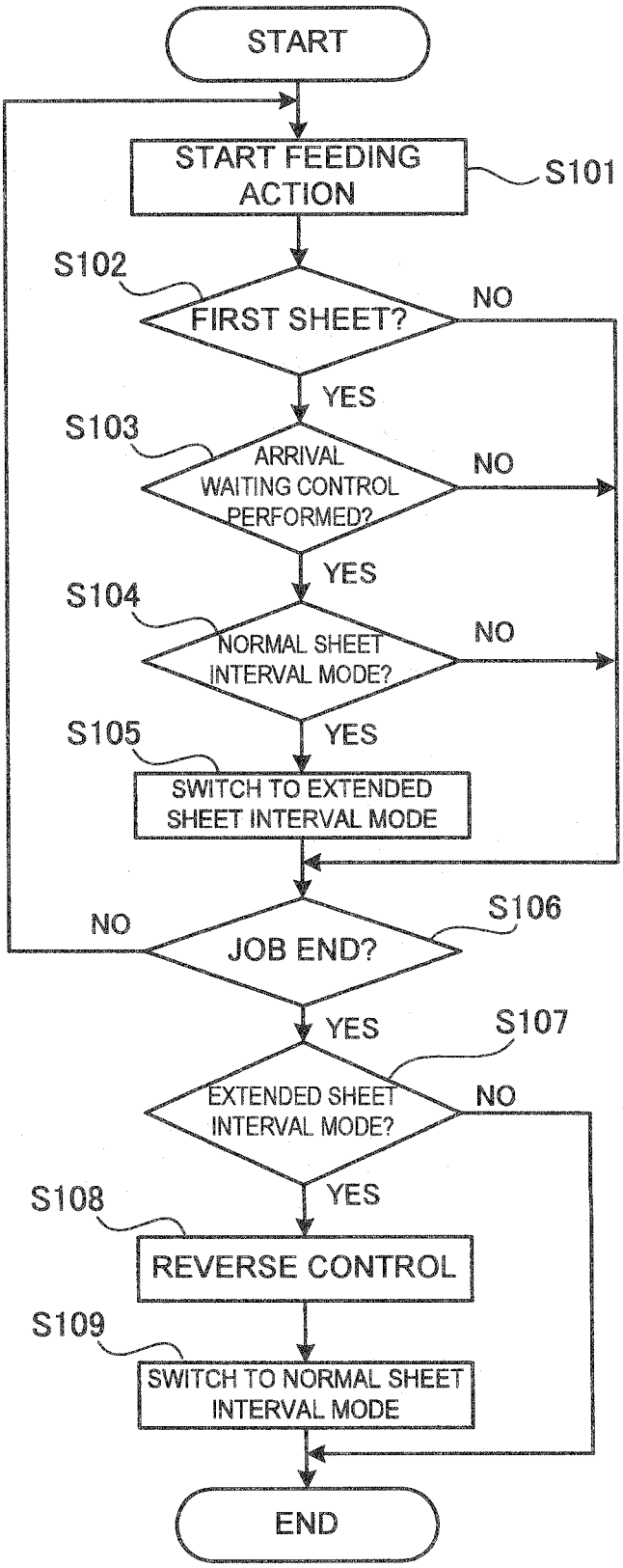
FIG. 8 is a flow chart for explaining a process of determining a timing of switching a normal sheet interval mode and an extended sheet interval mode in the first embodiment.

Next, a process of determining a timing of switching the normal sheet interval mode and the extended sheet interval mode in the present embodiment is explained referring to a flow chart of FIG. 8. When the image forming apparatus 1 receives a job command of carrying out image forming on the paper P on the manual feeding tray 71, the CPU 6 starts a flow shown in FIG. 8. To be specific, when the CPU 6 starts the job and the feeding action for image forming is to be performed by the sheet feed roller 72 (S101), it is determined whether or not that sheet feeding is made for the first sheet for the job (S102). More specifically, in a case that the job to be performed is the continuous printing, the CPU 6 determines that the feeding action about to be performed is the one made for the first paper among a plurality of feeding actions in the continuous printing. Further, in a case that the job is to form an image on one paper P, the feeding action is determined as the one to be performed for the first sheet.

When the feeding is made for the first paper (S102:YES), it is determined whether or not an arrival waiting control is carried out for that feeding (S103). The arrival waiting control of the present embodiment is the feed retry control. However, as mentioned above, a feeding action continuous control may be carried out as the arrival waiting control. Then, when the mode for continuous printing is set in the normal sheet interval mode, (S104:YES) and the arrival waiting control is carried out (S103:YES), the mode for the continuous printing is switched to the extended sheet interval mode (S105).

In feeding the first paper, it is highly possible to feed the additional paper BP as the paper P to be fed because the additional paper BP is apt to be supplied above the sheaf of initial papers AP. Further, when the arrival waiting control is carried out, there is a high possibility that the first initial paper AP1 has been fed on the way of the conveying path because the additional paper BP is loaded apart from the sheet feed roller 72. Accordingly, it is preferable to perform the continuous printing thereafter in the extended sheet interval mode.

On the other hand, when the feeding is to be performed for the second and subsequent papers (S102:NO), it is less probable that the paper P to be fed is the additional paper BP compared to the case of feeding the first sheet. Even if the plurality of additional papers BP are loaded apart from the sheet feed roller 72, when the feeding is carried out for the second and subsequent papers (S102:NO), the arrival waiting control has already been performed (S103:YES) in feeding the preceding first paper (S102:YES). Accordingly, the mode has already been switched to the extended sheet interval mode (S105). Even in a case of feeding the first paper (S102:YES), when the arrival waiting control is not carried out (S103:NO), there is a low possibility that the first initial paper AP1 has been conveyed on the way of the conveying path. Therefore, in those cases, it is determined that there is no necessity of switching the mode to the extended sheet interval mode. When the mode has been set in the extended sheet interval mode, (S104:NO), naturally, there is no need to switch the mode to the extended sheet interval mode.

When the image forming job of the continuous printing remains (S106:NO), the following feeding action is performed (S101). In a case that the first initial paper AP1 has been fed on the way of the conveying path by the preceding feeding action, the subsequent feeding action is carried out in the extended sheet interval mode. Therefore, image forming is carried out on the additional paper BP and the first initial paper AP1 without erroneously detecting size error and jam of the paper.

When the image forming job is terminated (S106:YES) with that feeding action (S101), it is determined whether or not the mode for the continuous printing at the job termination is the extended sheet interval mode (S107).

In a case that the job is terminated in the extended sheet interval mode (S107:YES), there is a high possibility that the first initial paper AP1 has been conveyed on the way of the conveying path. In such a case, the reverse control is carried out (S108). Thereby, the first initial paper AP1 conveyed on the way of the conveying path is returned to the manual feeding tray 71. Accordingly, as well as preventing curl on the first initial paper AP1 even if the feeding is carried out from the sheet feed cassettes 51 and 61 thereafter, the paper P is not obstructed with its conveyance for feeding.

After performing the reverse control, it is preferable to switch the mode for continuous printing to the normal sheet interval mode (S109) so that the next job is performed in the normal sheet interval mode with high productivity. If the mode is in the normal sheet interval mode at the job termination (S107:NO), there is no need to perform the reverse control (S108). In the present embodiment, after the termination of the image forming job, the mode for continuous printing is set in the normal sheet interval mode. Therefore, in the present embodiment, the next job is started in a state that the mode for continuous printing is set in the normal sheet interval mode.

In the process shown in the flow chart of FIG. 8, when the feeding is performed for the second and subsequent papers (S102:NO), switching the mode to the extended sheet interval mode (S105) is not carried out. However, this step S102 may be omitted. For example, there is a case that the additional papers BP are supplied twice above the sheaf of initial papers AP. In such a case, the additional paper(s) BP supplied first on the sheaf AP is positioned apart from the sheet feed roller 72, and the additional paper(s) BP supplied secondly on those sheaf AP and the first additional paper(s) BP is sometimes positioned to be in contact with the sheet feed roller 72. In this case, in feeding the second and subsequent papers, the arrival waiting control is carried out (S103:YES) and the first initial paper AP1 could be fed on the way of the conveying path. Therefore, by not performing the determination in step S102, switching to the extended sheet interval mode (S105) can be properly carried out in the above mentioned case. Moreover, the determination from steps S107 to S109 is not indispensable or, only the step S109 may be omitted.

When the paper P on the manual feeding tray 71 becomes empty while the job for continuous printing is being performed in the extended sheet interval mode (S101 to S106), it is preferable to switch the mode for continuous printing to the normal sheet interval mode. For example, when all the papers P on the manual feeding tray 71 are fed during the job of continuous printing, a user supplies paper(s) P to the manual feeding tray 71. At this time, the supplied paper(s) P are highly possibly supplied tidily. In other words, it is less probable that the paper(s) P is positioned apart from the sheet feed roller 72. Thereby, the suspended job for continuous printing can be restarted in the normal sheet interval mode with high productivity. Emptiness of the manual feeding tray 71 can be detected by the empty sensor 73.

Further, in the present embodiment, the continuous printing is carried out with switching the normal sheet interval mode and the extended sheet interval mode. This is effective especially when a separate waiting control to place the manual feeding tray 71 in the separated state while the job of feeding from the manual feeding tray 71 is not carried out. When the period of the separated state is long, the additional paper(s) BP is apt to be loaded on the manual feeding tray 71 in the separated state.

Second Embodiment

A second embodiment is now explained. The second embodiment is similar to the first embodiment as for the configuration of the image forming apparatus 1, the feed retry control and the reverse control performed in the image forming apparatus 1, and the normal sheet interval mode and the extended sheet interval mode as modes for continuous printing. The second embodiment differs from the first embodiment in a determination process of switching the mode for continuous printing between the normal sheet interval mode and the extended sheet interval mode.

Figure 9:
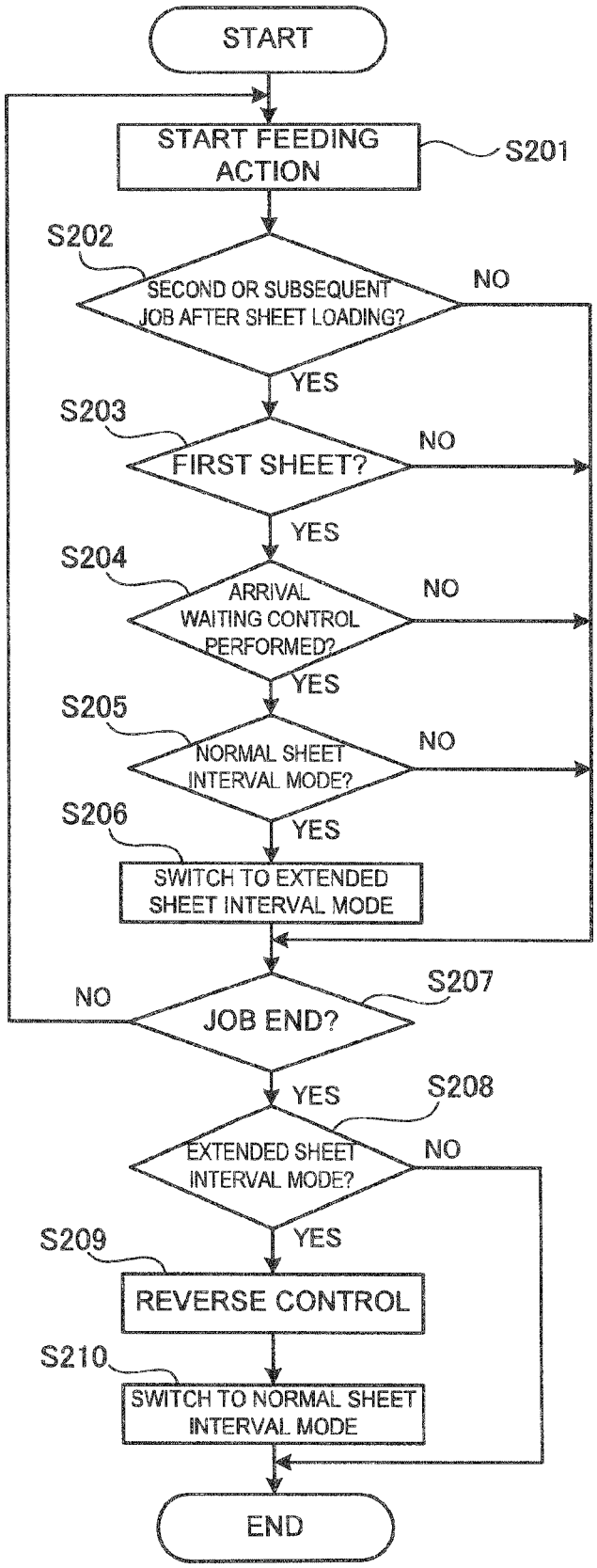
FIG. 9 is a flow chart for explaining a process of determining a timing of switching a normal sheet interval mode and an extended sheet interval mode in a second embodiment.

A determination process of switching the normal sheet interval mode and the extended sheet interval mode in the second embodiment is explained referring to a flow chart in FIG. 9. As shown in FIG. 9, the present embodiment is different from the first embodiment shown in FIG. 8 in a manner that a step S202 is added. Other steps S201 and S203 to S210 are respectively similar to the steps S101 to S109 in the first embodiment shown in FIG. 8.

In the present embodiment, when the job is started and the feeding action by the sheet feed roller 72 is carried out for image forming (S201), it is determined whether or not the job is the second or subsequent one after the paper P is loaded on the manual feeding tray 71 (S202). Namely, when a detection state detected by the empty sensor 73 is changed from sheet absence to sheet presence, and then the job of feeding the paper from the manual feeding tray 71 is carried out at least once before carrying out the present job, it is determined that the present job is the second or subsequent one (S202:YES).

When the present job is the second or subsequent one after the paper P is loaded (S202:YES), it is determined whether or not to switch the mode for continuous printing to the extended sheet interval mode in steps S203 to S205. On the other hand, in a case that the present job is the first one after the paper P is loaded (S202:NO), the mode for continuous printing is not switched to the extended sheet interval mode.

After the paper(s) P is loaded on the empty manual feeding tray 71, the additional paper(s) BP is unlikely to be supplied before the first job is started. On the contrary, when the job for continuous printing is carried out in the first job, the number of papers P on the manual feeding tray 71 may be lessened at the termination of the first job. Therefore, until the second and subsequent jobs after loading the paper P on the manual feeding tray 71 are started, there is a high possibility that the additional paper(s) BP is supplied because the sheaf of initial papers AP on the manual feeding tray 71 are lessened.

In response to this, in the present embodiment, when the present job is the first one after the paper(s) P is loaded, the mode for continuous printing is not switched to the extended sheet interval mode. When the present job is the first one after the paper(s) P is loaded, even if the arrival waiting control is carried out, it is highly probable that the arrival waiting control is carried out due to normal feeding failure by slip and others. In the normal sheet interval mode, high productivity can be maintained.

As for counting the number of jobs in the present embodiment, a job suspended due to emptiness of the paper P on the manual feeding tray 71 is also included. Specifically, when the job for continuous printing is suspended since the manual feeding tray 71 gets empty and the printing is restarted after supplying and loading the paper P, this job is counted as one.

Third Embodiment

A third embodiment is now explained. The third embodiment is also similar to the foregoing embodiments as for the configuration of the image forming apparatus 1, the feed retry control and the reverse control carried out in the image forming apparatus 1, and the normal sheet interval mode and the extended sheet interval mode as modes for continuous printing. The third embodiment differs from the foregoing embodiments in a determination process of switching the mode for continuous printing between the normal sheet interval mode and the extended sheet interval mode.

Figure 10:
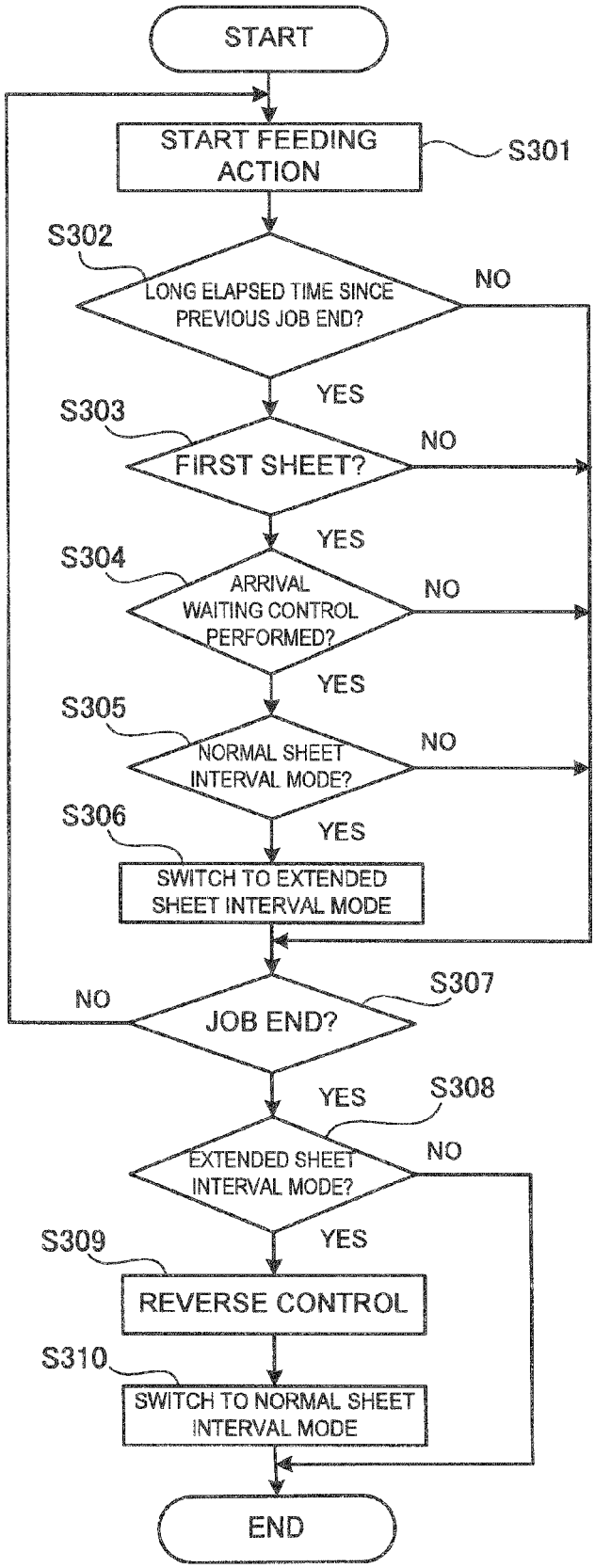
FIG. 10 is a flow chart for explaining a process of determining a timing of switching a normal sheet interval mode and an extended sheet interval mode in a third embodiment.

A determination process of switching the normal sheet interval mode and the extended sheet interval mode in the third embodiment is explained referring to a flow chart in FIG. 10. The present embodiment is, as shown in FIG. 10, different from the first embodiment in FIG. 8 in a manner that a step S302 is added. Other steps S301 and S303 to S310 are respectively similar to the steps S101 to S109 in the first embodiment in FIG. 8.

In the present embodiment, the feeding action of image forming is carried out by the sheet feed roller 72 (S301), and then it is determined whether or not the elapsed time since termination of the previous job is long (S302). Specifically, in a case that a period of time from termination of the previous job of feeding from the manual feeding tray 71 to start of the present job of feeding from the manual feeding tray 71 is equal to or longer than a predetermined period of time for sheet supply, it is concluded that the elapsed time since the termination of the previous job is long (S302:YES).

When the elapsed time since termination of the previous job is determined to be long (S302:YES), it is determined whether or not to switch the mode for continuous printing to the extended sheet interval mode in the steps S303 to S305. On the other hand, in a case that the elapsed time since the previous job termination is less than the sheet supply period (S302:NO), the mode for continuous printing is not switched to the extended sheet interval mode.

In a case that the period of time from termination of the previous job of feeding from the manual feeding tray 71 to the present job of feeding from the manual feeding tray 71 is long, there is a high possibility that the additional paper(s) BP is supplied. On the contrary, in a case that the period of time from termination of the previous job to start of the present job is short, the additional paper(s) BP is unlikely to be supplied. Namely, in the present embodiment, in a case of short elapsed time since the termination of the previous job, the mode for continuous printing is not switched to the extended sheet interval mode. This is because high productivity can be maintained in the normal sheet interval mode.

Fourth Embodiment

A fourth embodiment is now explained. The fourth embodiment is also similar to the foregoing embodiments as for the configuration of the image forming apparatus 1, the feed retry control and the reverse control carried out in the image forming apparatus 1, and the normal sheet interval mode and the extended sheet interval mode as modes for continuous printing. The fourth embodiment differs from the foregoing embodiments in a determination process of switching the modes for continuous printing between the normal sheet interval mode and the extended sheet interval mode.

Figure 11:
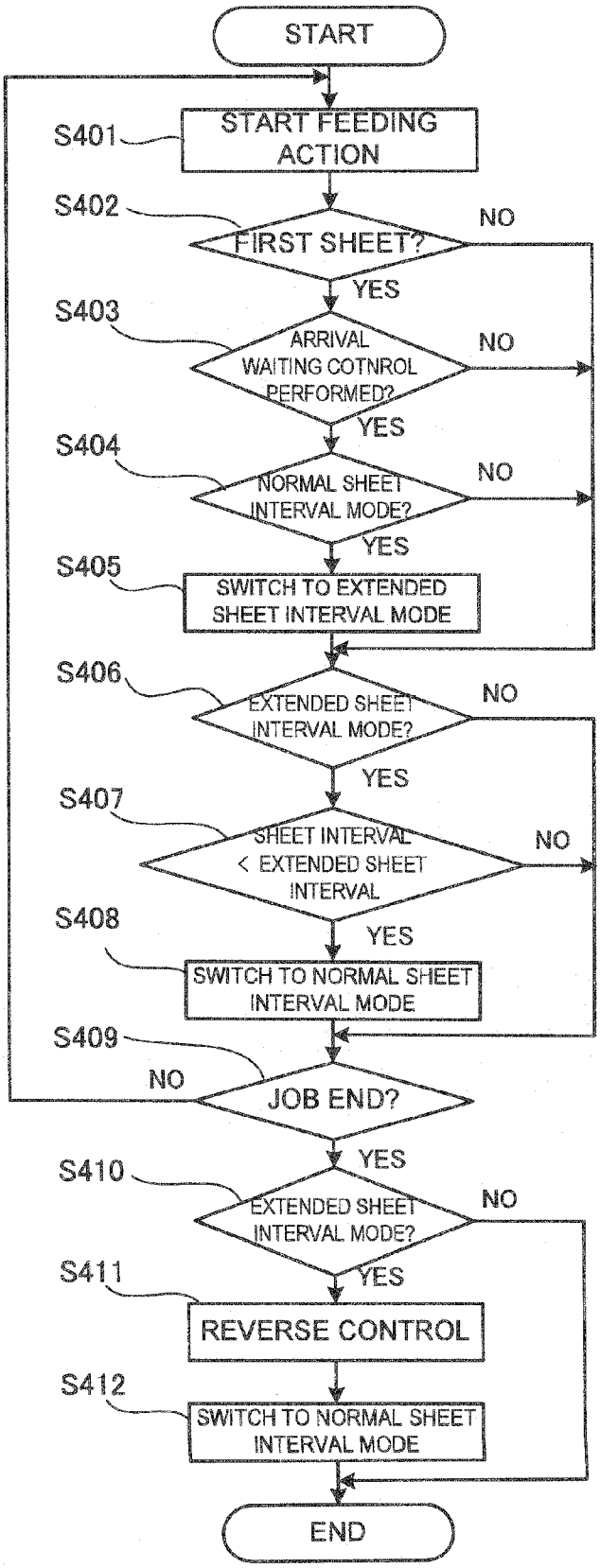
FIG. 11 is a flow chart for explaining a process of determining a timing of switching a normal sheet interval mode and an extended sheet interval mode in a fourth embodiment.

A determination process of switching the normal sheet interval mode and the extended sheet interval mode in the fourth embodiment is explained referring to a flow chart in FIG. 11. As shown in FIG. 11, the present embodiment differs from the first embodiment shown in FIG. 8 in a manner that steps S406 to S408 are added. Other steps S401 to S405 and S409 to S412 are respectively similar to the steps S101 to S109 in the first embodiment in FIG. 8.

In the present embodiment, when the feeding action for image forming is carried out by the sheet feed roller 72 (S401), as similar to the first embodiment, it is determined whether or not the mode for continuous printing is switched to the extended sheet interval mode (S402 to S405). Further, when the mode for continuous printing is the extended sheet interval mode (S406:YES), it is determined whether or not to switch the mode to the normal sheet interval mode.

Specifically, in the extended sheet interval mode (S406: YES), it is determined whether or not the sheet interval between the paper P for the present feeding and the paper P for the previous feeding is shorter than the extended sheet interval WS in the extended sheet interval mode (S407). To be more concrete, when the front end of the paper P for the present feeding is detected by the sheet sensor 40, the determination is made by determining whether or not the elapsed time since detection of the rear end of the paper P for the previous feeding is shorter than the period of time when the paper P is properly conveyed by the extended sheet interval WS. In a case that the sheet interval between the paper P for the present feeding and the paper P for the previous feeding is shorter than the extended sheet interval WS (S407:YES), the mode for continuous printing is switched to the normal sheet interval mode.

When the sheet interval between the paper P for the present feeding and the paper P for the previous feeding is shorter than the extended sheet interval WS, it is concluded that image forming on the first initial paper AP1, which has been fed on the way of the conveying path, has been carried out. Namely, even if the image forming is carried out thereafter in the normal sheet interval mode, there is no problem to be caused by the first initial paper AP1 staying on the way of the conveying path. Thus, the image forming can be carried out with high productivity in the normal sheet interval mode. In the step S407, when the sheet interval is shorter than a threshold value determined to be shorter than the extended sheet interval WS, the mode may be switched from the extended sheet interval mode to the normal sheet interval mode.

While the previous paper P has passed the detection point D in the extended sheet interval mode and then the feeding action for the following paper P is being carried out, the mode may be switched to the normal sheet interval mode in a case that the sheet interval for continuous printing is shorter than the distance Y from the front end of the paper P on the manual feeding tray 71 to the detection point D. Further, when the continuous printing is carried out with detecting the sheet interval as the present embodiment, it is preferable not to perform the erroneous detection prevention control by the sheet sensor 40. The sheet interval between the additional paper BP and the first initial paper AP1 is short because feeding of the first initial paper AP1 is started from the point where the first initial paper AP1 has already been conveyed on the way of the conveying path. Accordingly, if the erroneous detection prevention control is performed, that short sheet interval between the additional paper BP and the first initial paper AP1 might not be detected by the sheet sensor 40.

Fifth Embodiment

The fifth embodiment is now explained. The fifth embodiment is also similar to the foregoing embodiments as for the configuration of the image forming apparatus 1, the feed retry control and the reverse control carried out in the image forming apparatus 1, and the normal sheet interval mode and the extended sheet interval mode as modes for continuous printing. The fifth embodiment differs from the foregoing embodiments in a determination process of switching the mode for continuous printing between the normal sheet interval mode and the extended sheet interval mode.

FIG. 12 is a table showing feeding results of continuous printing in a state that the additional paper(s) BP is supplied disorderly above the sheaf of initial papers AP loaded properly on the manual feeding tray 71. FIG. 12 shows examples of performing the continuous printing in the normal sheet interval mode without switching the mode by the CPU 6.

Firstly, in a case that a gap (misalignment) of the additional paper BP with the sheaf of initial papers AP is shorter than 20 mm while the additional paper BP is supplied apart from the sheet feed roller 72, as indicated with "N/A" in FIG. 12, the feed retry control is not performed. In the image forming apparatus 1, when the gap of the additional paper BP is less than 20 mm, the front end of the additional paper BP reaches the detection point D of the sheet sensor 40 within the sheet feeding detection time since start of the feeding action. Further, as indicated with a sign "O" (which means "GOOD" and a sign "X" in the table means "BAD") in FIG. 12, both the additional paper BP and the first initial paper AP1 which are continuously fed are properly conveyed through the conveying path, and image forming is performed on surfaces of those papers.

In a case that the gap of the additional paper BP is equal to or longer than 20 mm and shorter than 30 mm, as indicated with "YES" in FIG. 12, the feed retry control is performed. When the gap of the additional paper BP is 20 mm or longer, the front end of the additional paper BP does not reach the detection point D within the sheet feeding detection time since start of the feeding action. However, when the gap of the additional paper BP is 20 mm or longer and shorter than 30 mm, after the feed retry control is carried out, the continuous printing for the additional paper BP and the first initial paper AP1 is properly in the normal sheet interval mode as indicated with "0" in FIG. 12. In other words, without overlapping the additional paper BP and the first initial paper AP1 and without erroneously detecting jam and others in the erroneous detection prevention control for preventing misdetection due to chattering, the continuous printing is carried out. This is because the distance Z1 explained in FIGS. 5 and 6 is short enough compared to the normal sheet interval RS in a case that the gap of the additional paper BP is 20 mm or longer and less than 30 mm.

In a case that the gap of the additional paper BP is equal to or longer than 30 mm, after the feed retry control is carried out as indicated with "YES" in the table, the continuous printing is stopped because jam or size error is detected. Specifically, in a case that the gap of the additional paper BP is 30 mm or longer and shorter than 35 mm, jam of the first initial paper AP1 is detected and thereby the continuous printing is stopped. Further, in a case that the gap of the additional paper BP is equal to or longer than 35 mm, size error of the additional paper BP is detected and thereby the continuous printing is stopped.

Accordingly, from the table of FIG. 12, in the image forming apparatus 1, when the gap of the additional paper BP is equal to or longer than 20 mm and shorter than 30 mm, the feed retry control is carried out and the continuous printing can be performed in the normal sheet interval mode. However, when the gap of the additional paper BP is equal to or longer than 30 mm, the continuous printing cannot be performed in the normal sheet interval mode.

Figure 13:
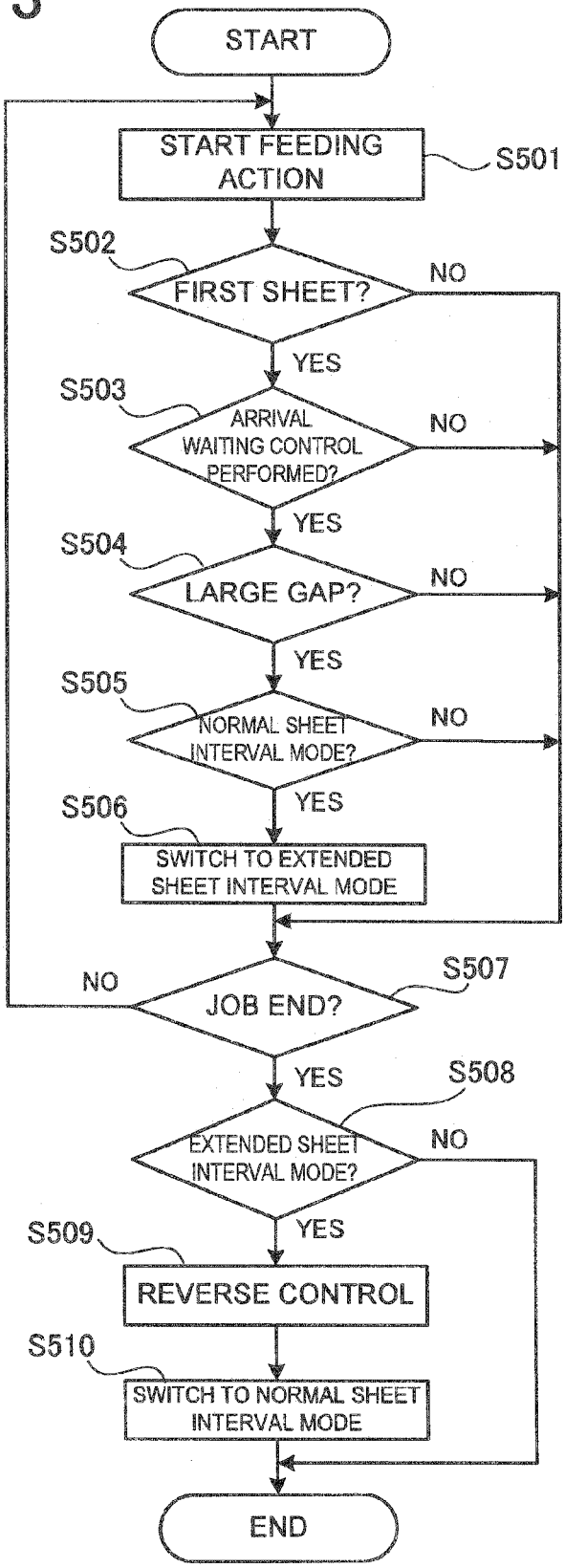
FIG. 13 is a flow chart for explaining a process of determining a timing of switching a normal sheet interval mode and an extended sheet interval mode in a fifth embodiment.

Therefore, in the present embodiment, when the gap of the additional paper BP is less than 30 mm, the continuous printing is performed in the normal sheet interval mode with high productivity. A determination process of switching the normal sheet interval mode and the extended sheet interval mode in the present embodiment is explained referring to a flow chart in FIG. 13. As shown in FIG. 13, the present embodiment differs from the first embodiment in FIG. 8 in a manner that a step S504 is added. Other steps S501 to S503 and S505 to S510 are respectively similar to the steps S101 to S109 of the first embodiment in FIG. 8.

In the present embodiment, the feeding action for image forming is carried out by the sheet feed roller 72 (S501), and when the arrival waiting control is carried out (S503:YES) for feeding the first sheet (S502:YES), it is determined whether or not the gap of the conveyed paper P is large (S504). In the present embodiment, it is determined whether or not the gap of the conveyed paper P is large based on a rotation time of the sheet feed roller 72 from start of the initial feeding for conveying the paper by the sheet feeding detection distance X to arrival of the paper P at the detection point D. Namely, the determination is made based on an initial paper projecting time as the rotation time of the sheet feed roller 72 rotating by the initial paper projecting distance Z1.

In other words, it is determined whether or not the initial paper projecting time is equal to or longer than an allowable initial paper projecting time as a predetermined threshold value of the rotation time of the sheet feed roller 72. When the initial paper projecting time is equal to or longer than the allowable initial paper projecting time and the gap of the conveyed paper P is determined to be large (S504:YES) in the normal sheet interval mode (S505:YES), the mode is switched to the extended sheet interval mode (S506). If the initial paper projecting time is shorter than the allowable initial paper projecting time and the gap of the fed paper P is determined to be small (S504:NO), the mode for continuous printing is not switched to the extended sheet interval mode.

When the gap of the conveyed paper P is large, the following continuous printing is not properly carried out in the normal sheet interval mode due to generation of jam and others. On the other hand, when the gap of the conveyed paper P is small, the following continuous printing can be carried out in the normal sheet interval mode with high productivity without generating jam and others.

Herein, the allowable initial paper projecting time may be varied depending on the configuration of the image forming apparatus and the preset normal sheet interval RS. Further, whether or not the gap of the conveyed paper P is large (S504) can be determined by an initial paper projecting rotation amount as the rotation amount of the sheet feed roller 72 rotating from start of the initial feeding action and conveyance of the paper P by the sheet feeding detection distance X to arrival of the paper P at the detection point D.

Figure 14:
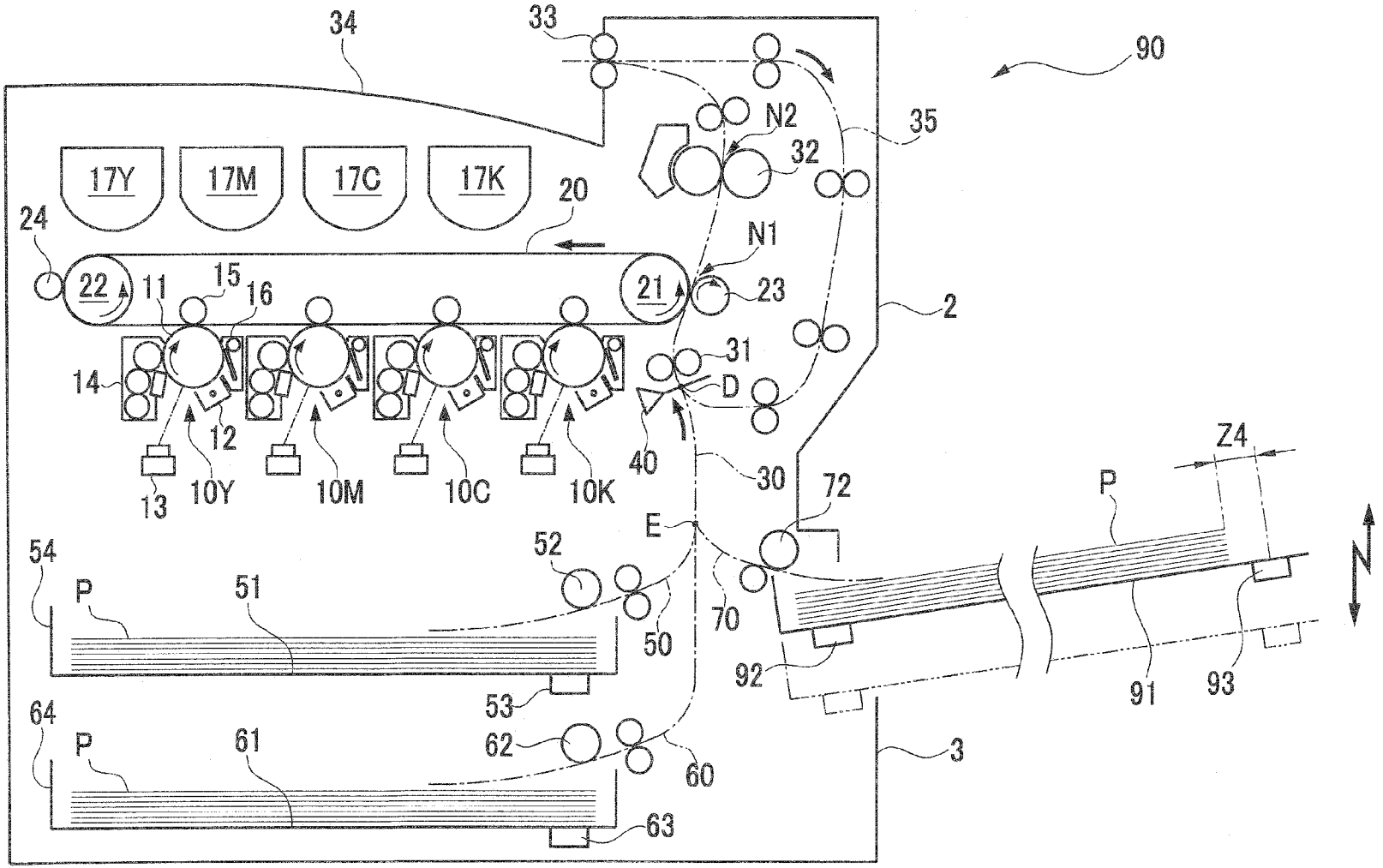
FIG. 14 is a schematic view showing an image forming apparatus applied with a configuration of the flow chart (FIG. 13) in the fifth embodiment.

Further, the determination of whether or not the gap of the conveyed paper P is large (S504) may be carried out by providing a sensor on the manual feeding tray. FIG. 14 shows an image forming apparatus 90 applied with the flow chart in FIG. 13 of the present embodiment. The image forming apparatus 90 has a manual feeding tray 91 which is different from the image forming apparatus 1 in FIG. 1. Other configuration except the manual feeding tray 91 of the image forming apparatus 90 is similar to the above mentioned image forming apparatus 1 in FIG. 1.

In the image forming apparatus 90, the papers P loaded on the manual feeding tray 91 are fed from the topmost one to the sheet feed passage 70 by the feeding action of the sheet feed roller 72. The manual feeding tray 91 is not provided with an element for restricting the rear end of the paper P and is configured to be positioned in the sheet feed enabling position indicated with a bold line and the separated position indicated with a double-dotted line in FIG. 14.

The manual feeding tray 91 is provided with an empty sensor 92 for detecting the loaded paper P and an abnormal sheet detection sensor 93. The empty sensor 92 is, as similar to the empty sensor 73 provided on the manual feeding tray 71 of the above image forming apparatus 1, to detect the front end side in the conveyance direction of the paper P loaded on the manual feeding tray 91 as a detection point. Namely, the sensor 92 is configured to detect emptiness of the paper P on the manual feeding tray 91.

The abnormal sheet detection sensor 93 is provided in a distant position from the sheet feed roller 72 on the manual feeding tray 91. To be specific, the abnormal sheet detection sensor 93 is provided to detect a position apart from the sheet feed roller 72 by a distance Z4 than the rear end of the paper P loaded properly on the manual feeding tray 91. Accordingly, when the paper P is properly loaded on the manual feeding tray 91, the paper P is not detected by the abnormal sheet detection sensor 93. On the other hand, when there is a paper P disorderly loaded on the manual feeding tray 91 with large misalignment, the abnormal sheet detection sensor 93 detects that paper.

In the present embodiment, the distance Z4 is determined as 30 mm. The CPU 6 can obtain the rear end of the paper P properly loaded on the manual feeding tray 91 by inputting the size of the paper P loaded on the manual feeding tray 91 by a user, for example. Therefore, when the additional paper BP is supplied with misaligned by 30 mm or more with respect to the sheaf of initial papers AP which are properly loaded, that additional paper BP is detected as an abnormal one by the abnormal sheet detection sensor 93.

Then, in the image forming apparatus 90, in a step S504 in FIG. 13, whether or not the gap of the conveyed paper P is large can be determined by the abnormal sheet detection sensor 93. When the feeding action is started (S501) and the abnormal sheet detection sensor 93 detects the paper P, it is determined that a paper P with large misalignment is present (S504:YES).

In this case, in the arrival waiting control (S503:YES), the first initial paper AP1 might be conveyed by the distance Z4 of 30 mm or more. Namely, there is a possibility of generation of jam and others thereafter by performing the continuous printing in the normal sheet interval mode. Accordingly, when the mode for continuous printing is the normal sheet interval mode (S505:YES), the mode is switched to the extended sheet interval mode (S506).

When the abnormal sheet detection sensor 93 does not detect the paper P and there is no paper P with large misalignment (S504:NO), the continuous printing can be carried out with high productivity in the normal sheet interval mode without switching to the extended sheet interval mode.

Sixth Embodiment

A sixth embodiment is now explained. The sixth embodiment is also similar to the foregoing embodiments as for the configuration of the image forming apparatus 1, the feed retry control and the reverse control carried out in the image forming apparatus 1, and the normal sheet interval mode and the extended sheet interval mode as modes for continuous printing. The sixth embodiment differs from the foregoing embodiments as for a timing of performing the reverse control.

Figure 15:
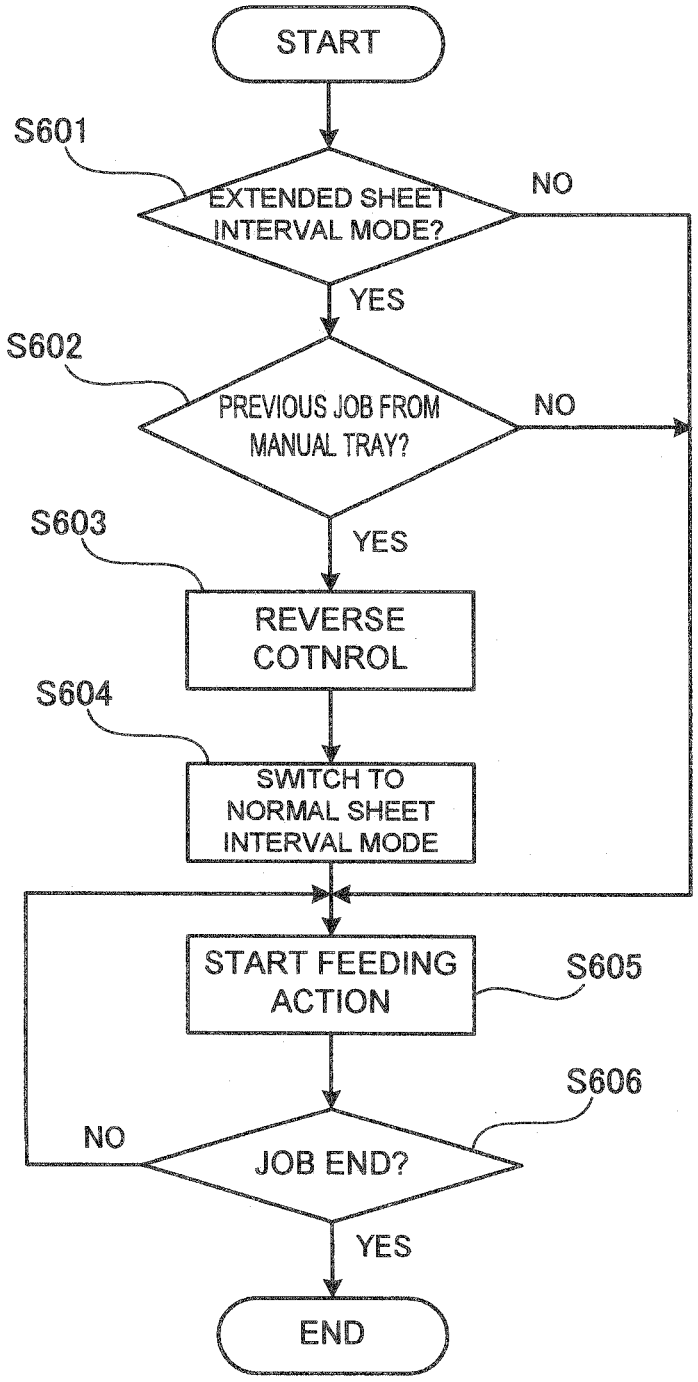
FIG. 15 is a flow chart for explaining a process of performing a reverse control in a sixth embodiment.

A process of performing the reverse control in the sixth embodiment is explained referring to a flow chart in FIG. 15. Unlike the foregoing embodiments, the flow chart in FIG. 15 is for performing image forming by feeding the paper P from the sheet feed cassettes 51 and 61. Namely, the CPU 6 inputs the job command to the image forming apparatus 1 to carry out image forming on the paper P loaded on the sheet feed cassettes 51 and 61 and starts the flow in FIG. 15.

In the image forming apparatus 1 carrying out the flow of FIG. 15 in the present embodiment, when performing the job of feeding the paper P from the manual feeding tray 71, the reverse control is not carried out after termination of that job. For example, when the paper P is fed from the manual feeding tray 71 in the image forming apparatus 1 carrying out the flow of FIG. 8, the apparatus is arranged not to carry out the steps S107 to S109. Therefore, when the job of feeding the paper P from the manual feeding tray 71 in the extended sheet interval mode, there is a case that the first initial paper AP1 which has been conveyed on the way of the conveying path remains.

Accordingly, in the present embodiment, when the job of feeding the paper P from the sheet feed cassettes 51 and 61 is input, it is determined whether or not the mode for continuous printing with the manual feeding tray 71 is set in the extended sheet interval mode (S601) as shown in FIG. 15. When the mode is set as the extended sheet interval mode (S601:YES), it is determined whether or not the previously performed job is the job of feeding the paper P from the manual feeding tray 71 (S602).

In a case that the previous job is made by feeding the paper from the manual feeding tray 71 (S602:YES), after performing the reverse control (S603) and switching the mode for continuous printing to the extended sheet interval mode (S604), the present job is started. In the present job, the feeding action of feeding the paper P from the sheet feed cassettes 51 and 61 (S605), and the flow of FIG. 15 is ended after termination of the present job (S606:YES).

In FIG. 15, if there is the first initial paper AP1 which has been conveyed on the way of the passage, the reverse control is carried out before start of the present job. By the time when the present job is started, the first initial paper AP1 is returned to the manual feeding tray 71. Thus, the present job of feeding the paper P from the sheet feed cassettes 51 and 61 can be carried out without being obstructed by the first initial paper AP1 conveyed on the way of the conveying path. Further, in the present embodiment, the job of feeding the paper from the manual feeding tray 71 can be carried out successively without performing the reverse control. Accordingly, compared to a case of certainly performing the reverse control at the termination of the job, it is possible to perform the job of continuously feeding the papers from the manual feeding tray 71 in short time.

In a case that the mode for continuous printing with the manual feeding tray 71 is set in the normal sheet interval mode (S601:NO), the present job is started without performing the reverse control (S603) and switching the mode for continuous printing to the extended sheet interval mode (S604). Further, also in a case that the previous job is not the one to feed the paper from the manual feeding tray 71 (S602: NO), the present job is started without performing the reverse control (S603) and switching the mode for continuous printing to the extended sheet interval mode (S604). In those cases, there is no first initial paper AP1 which has been conveyed on the way of the conveying path, and naturally, conveyance of the paper P fed from the sheet feed cassettes 51 and 61 is not obstructed.

As explained above, in the image forming apparatus of the above embodiments, when the arrival waiting control is not carried out, the state of mode for continuous printing set as the normal sheet interval mode is not switched to the extended sheet interval mode and image forming is continued. As a result, continuous printing can be carried out in the normal sheet interval mode with high productivity. On the other hand, in a case that the arrival waiting control is carried out, it is highly probable that the paper which has been conveyed on the way of the conveying path is present. Therefore, in certain cases that the arrival waiting control is carried out, continuous printing is carried out thereafter in the extended sheet interval mode. Thus, the continuous printing is carried out with ensuring enough sheet interval between the paper which has been conveyed on the way of the conveying path and the preceding paper. Accordingly, an image forming apparatus can be realized with preventing a problem of failing to ensure enough sheet interval in continuous printing due to disorderly supplied papers.

The present embodiments are only illustration for the present invention and not to limit the subject matter of the invention. The present invention may be therefore applied with various changes and modifications without departing from the scope of the invention. For example, the present embodiments are explained by switching the mode for continuous printing between the normal sheet interval mode and the extended sheet interval mode only in the manual feeding tray, but the invention is not limited to this. Other sheet feed cassettes may also be switched the mode for continuous printing between the normal sheet interval mode and the extended sheet interval mode. Further for example, the present invention is not limited to a color printer and is applicable to an image forming apparatus conducting transmission and reception of printing jobs through public lines. Further alternatively, the present invention is not limited to an apparatus having an intermediate transfer belt and is applicable to an image forming apparatus having a sheet holding belt.

The above mentioned image forming apparatus preferably includes a following sheet projecting amount obtention part for obtaining a following sheet projecting amount corresponding to an extra amount of the sheet conveyance amount to a distance from the sheet feed roller to the detection point on the conveying path, the projecting amount being counted from start of the feeding action to actual detection of the sheet detected by the conveyed sheet detection part when the arrival waiting control is performed, wherein the sheet interval control part controls the extended sheet interval by adding a distance corresponding to the following sheet projecting amount to the normal sheet interval. In this manner, continuous printing can be performed with ensuring the sheet interval as the normal sheet interval between the sheet which has already been conveyed on the way of the conveying path and the preceding sheet.

In the above mentioned image forming apparatus, preferably, the sheet interval control part is configured to set the extended sheet interval to be longer than the normal sheet interval in the extended sheet interval mode by starting the feeding action of a second one of successive two sheets after a rear end of a first one of the successive two sheets during a continuous printing job is detected by the conveyed sheet detection part. In a case that the following sheet has already been conveyed on the way of the conveying path, the feeding action of that sheet can be performed after the preceding sheet has certainly passed thorough a detection point of the conveyed sheet detection part. Accordingly, the sheet interval between the preceding sheet and the following sheet can be surely ensured.

In the above mentioned image forming apparatus, preferably, when the sheet interval mode is set as the normal sheet interval mode, when a sheet detected by the conveyed sheet detection part is a second or subsequent sheet in the continuous printing job, the sheet interval control part maintains the normal sheet interval mode irrespective of whether or not the arrival waiting control is performed. If there are sheets disorderly supplied, the topmost one of the disorderly supplied sheets is highly probable to be initially fed. This is because sheets are unlikely to be supplied during the job being carried out. Therefore, the arrival waiting control for the second and the subsequent sheets is highly probable to be performed due to usual feeding failure such as a slip. Accordingly, in a case that there is a high possibility that the arrival waiting control is performed due to the usual feeding failure such as a slip, the continuous printing can be carried out in the normal sheet interval mode with high productivity.

The above mentioned image forming apparatus preferably includes a loaded sheet detection part for detecting presence or absence of the sheet loaded on the sheet loading section, and wherein, when a sheet interval mode is set as the normal sheet interval mode, when a present job about to be performed from now is an initial job to be performed first after a detection state of the sheet by the loaded sheet detection part is changed from sheet absence to sheet presence, the sheet interval control part maintains the normal sheet interval mode irrespective of whether or not the arrival waiting control is performed. It is highly probable that sheets are supplied on the sheet loading section. Therefore, the arrival waiting control carried out at the initial job to be carried out after the sheets are tidily and properly supplied on the empty sheet loaded section is likely to be performed due to the usual feeding failure such as a slip. Accordingly, in a case that there is a high possibility that the arrival waiting control is performed due to the usual feeding failure such as a slip, the continuous printing can be performed in the normal sheet interval mode with high productivity.

In the above mentioned image forming apparatus, preferably, when a sheet interval mode is set as the extended sheet interval mode, the sheet interval control part maintains the extended sheet interval mode when a period of time from detection of a rear end of a first one of successive two sheets detected by the conveyed sheet detection part to detection of a front end of a second one of the successive two sheets detected by the conveyed sheet detection part exceeds a predetermined extension release time, and the sheet interval control part switches the extended sheet interval mode to the normal sheet interval mode when the period of time is less than the extension release time. If the time is equal to or less than the extension release time, the sheet interval mode is switched from the extended sheet interval mode to the normal sheet interval mode. Specifically, in a case that the sheet interval between the rear end of the preceding sheet and the front end of the subsequent sheet during continuous printing in the extended sheet interval mode is short, the subsequent sheet is concluded to have already been conveyed on the way of the conveying path. Then, after feeding the sheet on the way of the conveying path, the continuous printing can be carried out in the normal sheet interval mode with high productivity.

The above mentioned image forming apparatus preferably includes an erroneous detection prevention part for performing an erroneous detection prevention control only in the normal sheet interval mode to prevent misdetection of the front and rear ends of the sheet by disregarding a detection state of indicating sheet absence when the detection state of the sheet by the conveyed sheet detection part changes from sheet presence to sheet absence and then to sheet presence and a period of time of the sheet absence is equal to or less than a predetermined detection disregard time. When the sheet which has already been conveyed on the way of the conveying path is fed as a following one of the successive two sheets, the sheet interval with the preceding sheet is sometimes quite short. Therefore, it is preferable not to perform the detection disregard control of preventing misdetection due to so-called chattering by the conveyed sheet detection part so that the short sheet interval is detected in the extended sheet interval mode.

The above mentioned image forming apparatus preferably includes a following sheet projecting amount obtention part for obtaining a following sheet projecting amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, wherein, in the normal sheet interval mode, when the following sheet projecting amount is equal to or less than an allowable following sheet projecting amount as a predetermined threshold value, the sheet interval control part maintains the normal sheet interval mode irrespective of whether or not the arrival waiting control is performed. Further, preferably, in the normal sheet interval mode, the sheet interval control part maintains the normal sheet interval mode with no regard to whether or not the arrival waiting control is performed when the following sheet projecting amount is equal to or less than an allowable following sheet projecting amount as a predetermined threshold value. When the following sheet projecting amount in the arrival waiting control is not so large, the sheet, which has been conveyed on the way of the conveying path in the arrival waiting control, has been conveyed by not so long distance. Thus, even if this sheet conveyed on the way of the conveying path is fed in the normal sheet interval mode, the sheet interval with the preceding sheet is ensured enough. It is therefore preferable to carry out the continuous printing in the normal sheet interval mode with high productivity in this case.

The above mentioned image forming apparatus preferably includes an abnormal sheet detection part for detecting an abnormal sheet of the sheets loaded on the sheet loading section, the abnormal sheet being loaded with a front end apart from the sheet feed roller by a distance longer than a predetermined allowable distance, wherein, in the normal sheet interval mode, when the abnormal sheet is not detected by the abnormal sheet detection part at start of the feeding action, the sheet interval control part maintains the normal sheet interval mode irrespective of whether or not the arrival waiting control is performed, and when the abnormal sheet is detected and only in a case that the arrival waiting control is performed, the sheet interval control part switches the normal sheet interval mode to the extended sheet interval mode. When there is no abnormal sheet, even if there is a sheet which has been conveyed on the way of the conveying path by the arrival waiting control, that sheet has been conveyed by not so long distance. Therefore, even if the sheet conveyed on the way of the conveying path is fed in the normal sheet interval mode, the sheet interval with the preceding sheet can be ensured enough. In this case, it is preferable to carry out the continuous printing in the normal sheet interval mode with high productivity.

The above mentioned image forming apparatus preferably includes a conveyed sheet detection part for detecting presence or absence of the sheet loaded on the sheet loading section, wherein, when a detection state of the sheet by the loaded sheet detection part is changed between sheet presence and sheet absence while the sheet interval mode is set in the extended sheet interval mode, the sheet interval control part switches the extended sheet interval mode to the normal sheet interval mode. There is a high possibility that the sheets are orderly supplied on the empty sheet loading section. When the sheet loading section gets empty, or when the sheets are loaded on the sheet loading section, it is preferable to carry out continuous printing in the normal sheet interval mode with high productivity thereafter.

In the above mentioned image forming apparatus, preferably, the sheet loading section has: a lift part movable between a sheet feed enabling position in which the loaded sheet is lifted up to be in contact with the sheet feed roller and a separated position in which the loaded sheet is separated from the sheet feed roller; and a reverse control part configured to perform reverse control of rotating the sheet feed roller in a reverse direction from a rotating direction in the feeding action while the lift part is held in the separated position, and the reverse control part is arranged to perform the reverse control when a job is completed in the extended sheet interval mode set as the sheet interval mode, and not to perform the reverse control in the normal sheet interval mode set as the sheet interval mode. When the job is completed in the extended sheet interval mode, there is a high possibility that the sheet conveyed on the way of the conveying path is present. On the other hand, when the job is completed in the extended sheet interval mode, the sheet conveyed on the way of the conveying path can be returned to the sheet loading section by the reverse control.

In the above mentioned image forming apparatus, preferably, the sheet loading section includes a plurality of sheet loading sections and the sheet feed roller includes a plurality of sheet feed rollers to provide a plurality of combinations of the sheet loading sections and the sheet feed rollers, a first sheet loading section of the sheet loading sections includes: a lift part movable between a sheet feed enabling position in which the sheet loaded on the first sheet loading section is lifted up to be in contact with a first sheet feed roller and a separated position in which the loaded sheet is separated from the sheet feed roller; and a reverse control part configured to perform reverse control of rotating the first sheet feed roller in a reverse direction from a rotating direction in the feeding action while the lift part is held in the separated position, the reverse control part is arranged in a manner that, when a first job of the feeding action performed by the first sheet feed roller is completed in the extended sheet interval mode, before a second job subsequent to the first job of the feeding action is performed, it is determined whether or not the second job of the feeding action is performed by the first sheet feed roller, the reverse control is performed before start of the second job of the feeding action when the second job is not the feeding action by the first sheet feed roller, and the reverse control is not performed when the second job is the feeding action by the first sheet feed roller. When the second job of the feeding action is not carried out with the first sheet feed roller, the reverse control is performed before start of the feeding action of the second job. When the second job is carried out with the first sheet feed roller, the reverse control is preferably not performed. When a job of feeding a sheet from another sheet loaded section while the sheet conveyed on the way of the conveying path is present, the sheet remaining on the conveying path obstructs conveyance of the conveyed sheet, thereby causing jam. Accordingly, it is preferable to carry out the reverse control in this case. On the contrary, even if the sheet conveyed on the way of the conveying path remains, when the next job is to carry out feeding from the same sheet loaded section, the reverse control does not necessarily have to be carried out. By not performing the reverse control, the productivity can be enhanced.

In the above mentioned image forming apparatus, preferably, when the reverse control part performs the reverse control, the sheet interval control part switches the extended sheet interval mode to the normal sheet interval mode. By the reverse control, the sheet conveyed on the way of the conveying path is returned to the sheet loading section.

The above mentioned image forming apparatus preferably includes a following sheet projecting amount obtention part for obtaining a following sheet projection amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, and in the reverse control, the reverse control part is configured to reversely rotate the sheet feed roller by a reverse rotation amount which is set to be equal to or larger than the following sheet projecting amount. This is because the sheet conveyed on the way of the conveying path can be carried out with the reverse control at least until the sheet is completely returned to the sheet loaded section.

In the above mentioned image forming apparatus, preferably, in the arrival waiting control, the arrival waiting control part is configured to perform feed retry control of stopping the feeding action and starting the action again.

REFERENCE SIGNS LIST

1 Image forming apparatus
2 Image forming part
6 CPU
10Y, 10M, 10C, 10K Image forming unit
40 Sheet sensor
71 Manual feeding tray
72 Sheet feed roller
D Detection point
N1 Transfer nip
P Paper
RS Normal sheet interval
WS Extended sheet interval

What is claimed is:

1. An image forming apparatus including:

a conveying section for performing a conveying action of conveying a sheet along a conveying path;

a sheet loading section for loading a plurality of sheets to be supplied to the conveying path, the sheets being loaded with their rear ends not restricted in a conveying direction;

a sheet feed roller located most upstream of the conveying section and configured to rotate to perform a feeding action of feeding a topmost one of the sheets loaded on the sheet loading section to the conveying path; and an image forming section for forming an image on the sheet conveyed through the conveying path, wherein the image forming apparatus includes:

a conveyed sheet detection part for detecting presence or absence of the sheet on a detection point upstream of a position where an image is formed on the sheet by the image forming section on the conveying path;

a conveyance amount counting part for counting a sheet conveyance amount indicating an amount of conveyance motion by the conveying section;

a sheet interval control part for switching a sheet interval mode in a continuous printing job of continuously forming images on a plurality of sheets between a normal sheet interval mode for performing the feeding action such that a sheet interval between two successive sheets during the continuous printing job is a predetermined normal sheet interval and an extended sheet interval mode for performing the feeding action such that the sheet interval is an extended sheet interval longer than the normal sheet interval; and an arrival waiting control part for performing arrival waiting control when the sheet conveyance amount counted from start of the feeding action by the conveyance amount counting part reaches a feeding detection conveyance amount as a predetermined threshold value but the conveyed sheet detection part does not detect the sheet, the arrival waiting control including delaying a timing of starting image forming by the image forming section until the conveyed sheet detection part detects the sheet while continuing the feeding action, and the sheet interval control part is configured:

to set the normal sheet interval mode as an initially setting mode, to maintain the normal sheet interval mode when the arrival waiting control is not carried out from start of the feeding action until detection of the sheet by the conveyed sheet detection part, or to switch the normal sheet interval mode to the extended sheet interval mode when the initially setting mode is not maintained.

2. The image forming apparatus according to claim 1, further including a following sheet projecting amount obtention part for obtaining a following sheet projecting amount corresponding to an extra amount of the sheet conveyance amount to a distance from the sheet feed roller to the detection point on the conveying path, the projecting amount being counted from start of the feeding action to actual detection of the sheet detected by the conveyed sheet detection part when the arrival waiting control is performed, wherein the sheet interval control part controls the extended sheet interval by adding a distance corresponding to the following sheet projecting amount to the normal sheet interval.

3. The image forming apparatus according to claim 1, wherein the sheet interval control part is configured to set the extended sheet interval to be longer than the normal sheet interval in the extended sheet interval mode by starting the feeding action of a second one of successive two sheets after a rear end of a first one of the successive two sheets during a continuous printing job is detected by the conveyed sheet detection part.

4. The image forming apparatus according to claim 1, wherein when the sheet interval mode is set as the normal sheet interval mode, when a sheet detected by the conveyed sheet detection part is a second or subsequent sheet in the continuous printing job, the sheet interval control part maintains the normal sheet interval mode irrespective of whether or not the arrival waiting control is performed.

5. The image forming apparatus according to claim 1, further including a loaded sheet detection part for detecting presence or absence of the sheet loaded on the sheet loading section, and wherein, when a sheet interval mode is set as the normal sheet interval mode, when a present job about to be performed from now is an initial job to be performed first after a detection state of the sheet by the loaded sheet detection part is changed from sheet absence to sheet presence, the sheet interval control part maintains the normal sheet interval mode irrespective of whether or not the arrival waiting control is performed.

6. The image forming apparatus according to claim 1, wherein when the sheet interval mode is set as the normal sheet interval mode, when a period of time from completion of a previous job to start of the first feeding action of a present job about to be performed is less than a predetermined sheet replenishment time, the sheet interval control part maintains the normal sheet interval mode irrespective of whether or not the arrival waiting control is performed.

7. The image forming apparatus according to claim 1, wherein when a sheet interval mode is set as the extended sheet interval mode, the sheet interval control part maintains the extended sheet interval mode when a period of time from detection of a rear end of a first one of successive two sheets detected by the conveyed sheet detection part to detection of a front end of a second one of the successive two sheets detected by the conveyed sheet detection part exceeds a predetermined extension release time, and the sheet interval control part switches the extended sheet interval mode to the normal sheet interval mode when the period of time is less than the extension release time.

8. The image forming apparatus according to claim 7, further including an erroneous detection prevention part for performing an erroneous detection prevention control only in the normal sheet interval mode to prevent misdetection of the front and rear ends of the sheet by disregarding a detection state of indicating sheet absence when the detection state of the sheet by the conveyed sheet detection part changes from sheet presence to sheet absence and then to sheet presence and a period of time of the sheet absence is equal to or less than a predetermined detection disregard time.

9. The image forming apparatus according to claim 1, further including a following sheet projecting amount obtention part for obtaining a following sheet projecting amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, wherein, in the normal sheet interval mode, when the following sheet projecting amount is equal to or less than an allowable following sheet projecting amount as a predetermined threshold value, the sheet interval control part maintains the normal sheet interval mode irrespective of whether or not the arrival waiting control is performed.

10. The image forming apparatus according to claim 1, further including an abnormal sheet detection part for detecting an abnormal sheet of the sheets loaded on the sheet loading section, the abnormal sheet being loaded with a front end apart from the sheet feed roller by a distance longer than a predetermined allowable distance, wherein, in the normal sheet interval mode, when the abnormal sheet is not detected by the abnormal sheet detection part at start of the feeding action, the sheet interval control part maintains the normal sheet interval mode irrespective of whether or not the arrival waiting control is performed, and when the abnormal sheet is detected and only in a case that the arrival waiting control is performed, the sheet interval control part switches the normal sheet interval mode to the extended sheet interval mode.

11. The image forming apparatus according to claim 1, further including a conveyed sheet detection part for detecting presence or absence of the sheet loaded on the sheet loading section, wherein, when a detection state of the sheet by the loaded sheet detection part is changed between sheet presence and sheet absence while the sheet interval mode is set in the extended sheet interval mode, the sheet interval control part switches the extended sheet interval mode to the normal sheet interval mode.

12. The image forming apparatus according to claim 1, wherein the sheet loading section has:

a lift part movable between a sheet feed enabling position in which the loaded sheet is lifted up to be in contact with the sheet feed roller and a separated position in which the loaded sheet is separated from the sheet feed roller; and a reverse control part configured to perform reverse control of rotating the sheet feed roller in a reverse direction from a rotating direction in the feeding action while the lift part is held in the separated position, and the reverse control part is arranged to perform the reverse control when a job is completed in the extended sheet interval mode set as the sheet interval mode, and not to perform the reverse control in the normal sheet interval mode set as the sheet interval mode.

13. The image forming apparatus according to claim 1, wherein the sheet loading section includes a plurality of sheet loading sections and the sheet feed roller includes a plurality of sheet feed rollers to provide a plurality of combinations of the sheet loading sections and the sheet feed rollers, a first sheet loading section of the sheet loading sections includes:

a lift part movable between a sheet feed enabling position in which the sheet loaded on the first sheet loading section is lifted up to be in contact with a first sheet feed roller and a separated position in which the loaded sheet is separated from the sheet feed roller; and a reverse control part configured to perform reverse control of rotating the first sheet feed roller in a reverse direction from a rotating direction in the feeding action while the lift part is held in the separated position, the reverse control part is arranged in a manner that, when a first job of the feeding action performed by the first sheet feed roller is completed in the extended sheet interval mode, before a second job subsequent to the first job of the feeding action is performed, it is determined whether or not the second job of the feeding action is performed by the first sheet feed roller, the reverse control is performed before start of the second job of the feeding action when the second job is not the feeding action by the first sheet feed roller, and the reverse control is not performed when the second job is the feeding action by the first sheet feed roller.

14. The image forming apparatus according to claim 12, wherein when the reverse control part performs the reverse control, the sheet interval control part switches the extended sheet interval mode to the normal sheet interval mode.

15. The image forming apparatus according to claim 13, wherein when the reverse control part performs the reverse control, the sheet interval control part switches the extended sheet interval mode to the normal sheet interval mode.

16. The image forming apparatus according to claim 12, further including a following sheet projecting amount obtention part for obtaining a following sheet projection amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, and in the reverse control, the reverse control part is configured to reversely rotate the sheet feed roller by a reverse rotation amount which is set to be equal to or larger than the following sheet projecting amount.

17. The image forming apparatus according to claim 13, further including a following sheet projecting amount obtention part for obtaining a following sheet projection amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, and in the reverse control, the reverse control part is configured to reversely rotate the sheet feed roller by a reverse rotation amount which is set to be equal to or larger than the following sheet projecting amount.

18. The image forming apparatus according to claim 14, further including a following sheet projecting amount obtention part for obtaining a following sheet projection amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, and in the reverse control, the reverse control part is configured to reversely rotate the sheet feed roller by a reverse rotation amount which is set to be equal to or larger than the following sheet projecting amount.

19. The image forming apparatus according to claim 15, further including a following sheet projecting amount obtention part for obtaining a following sheet projection amount corresponding to an extra amount of the sheet conveyance amount to a distance from the sheet feed roller to the detection point on the conveying path, the projecting amount being counted from start of the feeding action to actual detection of the sheet by the conveyed sheet detection part when the arrival waiting control is performed, and in the reverse control, the reverse control part is configured to reversely rotate the sheet feed roller by a reverse rotation amount which is set to be equal to or larger than the following sheet projecting amount.

20. The image forming apparatus according to claim 1, wherein in the arrival waiting control, the arrival waiting control part is configured to perform feed retry control of stopping the feeding action and starting the action again.

* * * * *